US011636818B2

(12) United States Patent
Liu et al.

(10) Patent No.: US 11,636,818 B2
(45) Date of Patent: Apr. 25, 2023

(54) DISPLAY PANEL, DRIVE METHOD THEREOF AND DISPLAY APPARATUS

(71) Applicant: BOE Technology Group Co., Ltd., Beijing (CN)

(72) Inventors: Weixing Liu, Beijing (CN); Tieshi Wang, Beijing (CN); Wei Qin, Beijing (CN); Zhiqiang Xu, Beijing (CN); Chunfang Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/353,841

(22) Filed: Jun. 22, 2021

(65) Prior Publication Data

US 2022/0165228 A1 May 26, 2022

(30) Foreign Application Priority Data

Nov. 24, 2020 (CN) ..... 202011334580.X

(51) Int. Cl.
*G09G 3/36* (2006.01)

(52) U.S. Cl.
CPC ..... *G09G 3/3648* (2013.01); *G09G 3/3677* (2013.01); *G09G 2300/0809* (2013.01); *G09G 2340/0407* (2013.01); *G09G 2354/00* (2013.01)

(58) Field of Classification Search
CPC ..... G09G 3/3648; G09G 3/3677; G09G 2300/0809; G09G 2340/0407; G09G 2354/00
See application file for complete search history.

(56) References Cited

U.S. PATENT DOCUMENTS

2005/0110720 A1* 5/2005 Akimoto ..... G09G 3/3258 345/76
2009/0219232 A1* 9/2009 Choi ..... G09G 3/3266 345/76
2011/0221789 A1* 9/2011 Ota ..... H01L 27/3267 345/690
2012/0033163 A1* 2/2012 Qin ..... H01L 27/12 438/34
2014/0368494 A1* 12/2014 Sakharnykh ..... G06T 5/10 345/419

(Continued)

FOREIGN PATENT DOCUMENTS

CN 109885273 A 6/2019

*Primary Examiner* — Benyam Ketema
(74) *Attorney, Agent, or Firm* — Ling Wu; Stephen Yang; Ling and Yang Intellectual Property

(57) ABSTRACT

Provided are a display panel, a drive method thereof and a display apparatus. The display panel includes a plurality of scan signal lines, a plurality of data signal lines and a plurality of sub-pixels; at least one sub-pixel includes switch assembly and a display unit, wherein the switch assembly at least includes a control terminal, an input terminal and an output terminal, wherein the input terminal is connected to the data signal line, the output terminal is connected to the display unit, and the control terminal or the input terminal is connected to the scan signal line; the display panel further includes at least one switch control line, which is connected to the control terminal of the switch assembly, and the switch control line is configured to control the input terminal and the output terminal of the switch assembly to be turned on or off.

19 Claims, 6 Drawing Sheets

(56) References Cited

U.S. PATENT DOCUMENTS

| | | | | |
|---|---|---|---|---|
| 2015/0364085 | A1* | 12/2015 | Kanda | G09G 3/3233 345/76 |
| 2016/0155385 | A1* | 6/2016 | Yang | G06F 3/042 345/174 |
| 2016/0267884 | A1* | 9/2016 | Binstock | G06T 3/4007 |
| 2018/0284876 | A1* | 10/2018 | Ray | H04N 7/0127 |
| 2019/0139496 | A1* | 5/2019 | Peng | G09G 3/3266 |
| 2019/0325823 | A1* | 10/2019 | Yang | G09G 3/3233 |
| 2019/0355332 | A1* | 11/2019 | Knez | G09G 3/2092 |
| 2019/0371232 | A1* | 12/2019 | Kim | H01L 25/0753 |
| 2020/0057491 | A1* | 2/2020 | Yang | G09G 3/2074 |
| 2020/0251049 | A1* | 8/2020 | Morris | G06F 1/163 |
| 2020/0251638 | A1* | 8/2020 | Morris | H01L 27/1255 |
| 2021/0096644 | A1* | 4/2021 | Wang | G06T 5/001 |
| 2021/0201769 | A1* | 7/2021 | Morris | G09G 5/003 |
| 2021/0225329 | A1* | 7/2021 | Shi | G06F 9/451 |
| 2021/0398507 | A1* | 12/2021 | Hicks | H04N 19/107 |
| 2022/0165228 | A1* | 5/2022 | Liu | G09G 3/3677 |

* cited by examiner

DISPLAY PANEL, DRIVE METHOD THEREOF AND DISPLAY APPARATUS

CROSS-REFERENCE TO RELATED APPLICATION

The present application claims the priority of Chinese Patent Application No. 202011334580.X, filed to the CNIPA on Nov. 24, 2020, the content of which is hereby incorporated by reference.

TECHNICAL FIELD

The present disclosure relates to, but is not limited to, the field of display technology, and particularly relates to a display panel, a drive method thereof, and a display apparatus.

BACKGROUND

With the development of display technology, Liquid Crystal Display (LCD) display apparatus and Organic Light Emitting Diode (OLED) display apparatus have become the mainstream products of flat panel display and are widely used in various electronic devices. With the development of smart wear, mobile application and other technologies, users have an increasingly high requirement for image display quality, and high-quality display has become a major development trend of the display apparatus at present.

A refresh rate generally refers to the times of scanning an image repeatedly on a display screen. The higher the refresh rate, the better the stability of the displayed image (picture). Therefore, a high-quality display requires a display apparatus to have a higher refresh rate. However, the high refresh rate will inevitably occupy a large amount of system resources of the display apparatus, which will increase data transmission capacity of the display apparatus and greatly increase power consumption of the display apparatus.

Therefore, how to save the system resources of the display apparatus is an urgent technical problem in the art.

SUMMARY

The following is a summary of subject matter described in detail herein. This summary is not intended to limit the protection scope of the claims.

The embodiment of the disclosure provides a display panel, which includes a plurality of scan signal lines, a plurality of data signal lines and a plurality of sub-pixels;

wherein at least one of the plurality of sub-pixels includes a switch assembly and a display unit, wherein the switch assembly at least includes a control terminal, an input terminal and an output terminal, wherein the input terminal is connected to the data signal line, the output terminal is connected to the display unit, and the control terminal or the input terminal is connected to the scan signal line;

the display panel further includes at least one switch control line connected to the control terminal of the switch assembly, and the switch control line is configured to control on or off of the input terminal and the output terminal of the switch assembly.

In an exemplary embodiment, the control terminal of the switch assembly includes a first control terminal and a second control terminal, the switch assembly includes a first transistor and a second transistor, and the switch control line includes a first control line; a gate electrode of a first transistor as the first control terminal is connected to the scan signal line, a gate electrode of a second transistor as the second control terminal is connected to the first control line, a first electrode of the first transistor as the input terminal is connected to the data signal line, a second electrode of the first transistor is connected to a first electrode of the second transistor, and a second electrode of the second transistor as the output terminal is connected to the display unit.

In an exemplary embodiment, at least one of the plurality of scan signal lines is connected to gate electrodes of first transistors of a plurality of sub-pixels in a sub-pixel row; the first control line includes a plurality of sub-control lines, and each sub-control line is connected to gate electrodes of second transistors of the plurality of sub-pixels in a sub-pixel row.

In an exemplary embodiment, the control terminal of the switch assembly includes a first control terminal, a second control terminal and a third control terminal, the switch assembly includes a first transistor, a second transistor and a third transistor, and the switch control line includes a first control line and a second control line; a gate electrode of a first transistor as the first control terminal is connected to the scan signal line, a gate electrode of a second transistor as the second control terminal is connected to the first control line, a gate electrode of a third transistor as the third control terminal is connected to the second control line, a first electrode of the first transistor as the input terminal is connected to the data signal line, a second electrode of the first transistor is connected to a first electrode of the second transistor, a second electrode of the second transistor is connected to a first electrode of the third transistor and a second electrode of the third transistor as the output terminal is connected to the display unit.

In an exemplary embodiment, at least one of the plurality of scan signal lines is connected to gate electrodes of first transistors of a plurality of sub-pixels in a sub-pixel row; the first control line is connected to gate electrodes of second transistors of a plurality of sub-pixels in a sub-pixel row; and the second control line is connected to gate electrodes of third transistors of a plurality of sub-pixels in a sub-pixel column.

In an exemplary embodiment, the control terminal of the switch assembly includes a first control terminal, the switch assembly includes a fourth transistor and a fifth transistor, and the switch control line includes a second control line; a gate electrode of a fourth transistor as the first control terminal is connected to the second control line, a first electrode of the fourth transistor is connected to the scan signal line, a second electrode of the fourth transistor is connected to a gate electrode of the fifth transistor, a first electrode of the fifth transistor as the input terminal is connected to the data signal line and a second electrode of the fifth transistor as the output terminal is connected to the display unit.

In an exemplary embodiment, at least one of the plurality of scan signal lines is connected to first electrodes of fourth transistors of a plurality of sub-pixels in a sub-pixel row; the second control line is connected to gate electrodes of fourth transistors of a plurality of sub-pixels in a sub-pixel column.

In an exemplary embodiment, the first control line is parallel to the scan signal lines, and the second control line is parallel to the data signal lines.

In an exemplary embodiment, the display unit includes a pixel electrode, or the display unit includes a pixel circuit and a light emitting device.

An embodiment of the present disclosure provides a drive method for a display panel, wherein:

the display panel includes a plurality of scan signal lines, a plurality of data signal lines and a plurality of sub-pixels;

wherein at least one of the plurality of sub-pixels includes switch assembly and a display unit, wherein the switch assembly at least includes a control terminal, an input terminal and an output terminal, wherein the input terminal is connected to the data signal lines, the output terminal is connected to the display unit, and the control terminal or the input terminal is connected to the scan signal lines;

the display panel also includes at least one switch control line which is connected to the control terminal of the switch assembly and is arranged to control the on or off of the input terminal and the output terminal of the switch assembly; the drive method includes:

acquiring a fixation position of a viewer on the display panel, and determining sub-pixels of a fixation region and sub-pixels of a non-fixation region in the display panel according to the fixation position;

controlling a refresh rate of the sub-pixels of the fixation region to be greater than a refresh rate of the sub-pixels of the non-fixation region.

In an exemplary embodiment, controlling refresh rate of the sub-pixels of the fixation region to be greater than refresh rate of the sub-pixels of the non-fixation region, includes:

controlling the input terminal and output terminal of the switch assembly in the sub-pixels of the fixation region and the sub-pixels of the non-fixation region to be turned on for all sub-pixel rows of the display panel when a first frame is displayed;

controlling the input terminal and output terminal of the switch assembly in the sub-pixels of the fixation region to be turned on and controlling input terminals and output terminals of the switch assembly in the sub-pixels of the non-fixation region to be turned off for all sub-pixel rows of the display panel when a second frame is displayed.

In an exemplary embodiment, the switch control line includes a first control line, and the switch assembly includes a first transistor and a second transistor; controlling the input and output terminals of the switch assembly in the sub-pixels of the fixation region to be turned on, and controlling the input and output terminals of the switch assembly in the sub-pixels of the non-fixation region to be turned off, includes:

for a sub-pixel row that do not include the sub-pixels of the fixation region, the plurality of scan signal lines outputting first on signals to turn a first transistor of each sub-pixel of the sub-pixel row on; the first control line outputting an off signal to turn a second transistor of each sub-pixel of the sub-pixel row off;

for a sub-pixel row including the sub-pixels of the fixation region, the scan signal line outputting a first on signal to turn a first transistor of each sub-pixel of the sub-pixel row on; the first control line outputting a second on signal and an off signal, wherein the second on signal is output to the sub-pixels of the fixation region and the off signal is output to the sub-pixels of the non-fixation region to turn the second transistor of the sub-pixels of the fixation region on and turn the second transistor of the sub-pixels of the non-fixation region off.

In an exemplary embodiment, the switch control line includes a first control line and a second control line, and the switch assembly includes a first transistor, a second transistor and a third transistor; controlling input terminals and output terminals of the switch assembly in the sub-pixels of the fixation region to be turned on and controlling input terminals and output terminals of the switch assembly in the sub-pixels of the non-fixation region to be turned off, includes:

for a sub-pixel row that do not include the sub-pixels of the fixation region, the scan signal lines outputting first on signals to turn a first transistor of each sub-pixel of the sub-pixel row on; the first control line outputting a second on signal to turn a second transistor of each sub-pixel of the sub-pixel row on; the second control line outputting an off signal to turn a third transistor of each sub-pixel of the sub-pixel row off;

for a sub-pixel row including the sub-pixels of the fixation region, the scan signal line outputting a first on signal to turn a first transistor of each sub-pixel of the sub-pixel row on; the first control line outputting a second on signal to turn a second transistor of each sub-pixel of the sub-pixel row on; the second control line outputting a third on signal and an off signal, wherein the third on signal is output to the sub-pixels of the fixation region and the off signal is output to the sub-pixels of the non-fixation region to turn third transistors of the sub-pixels of the fixation region on and turn third transistors of the sub-pixels of the non-fixation region off.

In an exemplary embodiment, the switch control line includes a second control line, and the switch assembly includes a fourth transistor and a fifth transistor; controlling input terminals and output terminals of the switch assembly in the sub-pixels of the fixation region to be turned on and controlling input terminals and output terminals of the switch assembly in the sub-pixels of the non-fixation region to be turned off, includes:

for a sub-pixel row that do not include the sub-pixels of the fixation region, the second control line outputting an off signal to turn a fourth transistor of each sub-pixel of the sub-pixel row off; the scan signal lines outputting first on signals;

for a sub-pixel row including the sub-pixels of the fixation region, the second control line outputting a third on signal and an off signal, wherein the third on signal is output to the sub-pixels of the fixation region and the off signal is output to the sub-pixels of the non-fixation region to turn fourth transistors of the sub-pixels of the fixation region on and turn fourth transistors of the sub-pixels of the non-fixation region off; the scan signal lines outputting first on signals to turn a fifth transistor of the sub-pixel of the fixation region on.

In an exemplary embodiment, controlling refresh rate of the sub-pixels of the fixation region to be greater than refresh rate of the sub-pixels of the non-fixation region, includes:

controlling input terminal and output terminal of the switch assembly in the sub-pixels of the fixation region and the sub-pixels of the non-fixation region to be turned on when a first frame is displayed;

for a sub-pixel row including sub-pixels of the fixation region, controlling input terminal and output terminal of the switch assembly in the sub-pixels of the fixation region to be turned on and controlling input terminal and output terminal of the switch assembly in the sub-pixels of the non-fixation region to be turned off when a second frame is displayed.

The embodiment of the disclosure provides a display apparatus which includes a visual tracking device, a control circuit and a display panel, wherein, the display panel includes a plurality of scan signal lines, a plurality of data signal lines and a plurality of sub-pixels;

wherein at least one of the plurality of sub-pixels includes switch assembly and a display unit, wherein the switch assembly at least includes a control terminal, an input terminal and an output terminal, wherein the input terminal is connected to the data signal lines, the output terminal is connected to the display unit, and the control terminal or the input terminal is connected to the scan signal lines;

the display panel further includes at least one switch control line which is connected to the control terminal of the switch assembly and is configured to control on or off of the input terminal and the output terminal of the switch assembly;

the control circuit is connected to the visual tracking device and the display panel;

the vision tracking device is configured to acquire a fixation position of a viewer on the display panel, and determine sub-pixels of a fixation region and sub-pixels of a non-fixation region in the display panel according to the fixation position;

the control circuit is configured to control a refresh rate of the sub-pixels in the fixation region to be greater than a refresh rate of the sub-pixels in the non-fixation region.

In an exemplary embodiment, the control circuit includes a gate drive circuit and a first control circuit, the gate drive circuit is connected to at least one scan signal line of the plurality of scan signal lines, and the first control circuit is connected to at least one first control line; or, the control circuit includes a gate drive circuit, a first control circuit, and a second control circuit, the gate drive circuit is connected to at least one of the plurality of scan signal lines, and the first control circuit is connected to at least one first control line, and the second control circuit is connected to at least one second control line; or, the control circuit includes a gate drive circuit and a second control circuit, wherein the gate drive circuit is connected to at least one of the plurality of scan signal lines, and the second control circuit is connected to at least one second control line.

In an exemplary embodiment, the control circuit further includes a scan control circuit, which is connected to the gate drive circuit, and the scan control circuit is configured to provide an initial signal or a reset signal to the gate drive circuit to scan a part of sub-pixel rows in a frame of display.

In an exemplary embodiment, the display panel includes a display region and a circuit region located on one or more sides of the display region, and the control circuit is disposed in the circuit region.

Of course, it is not necessary to simultaneously achieve all of the advantages mentioned above for any product or method implemented through the embodiments of the present disclosure. Other features and advantages of the present disclosure will be set forth in the following embodiments of the description, and in part will become apparent from the embodiments of the description, or be learned by practice of the present disclosure. Objects and other advantages of the present disclosure may be implemented and obtained by structures specifically pointed out in the specification, claims and drawings.

Other aspects will become apparent upon reading and understanding accompanying drawings and the detailed description.

BRIEF DESCRIPTION OF DRAWINGS

Accompanying drawings are used to provide an understanding of technical solutions of the present disclosure and form a part of the specification. Together with embodiments of the present disclosure, they are used to explain the technical solutions of the present disclosure and do not constitute a limitation on the technical solutions of the present disclosure.

DETAILED DESCRIPTION

Figure 1:
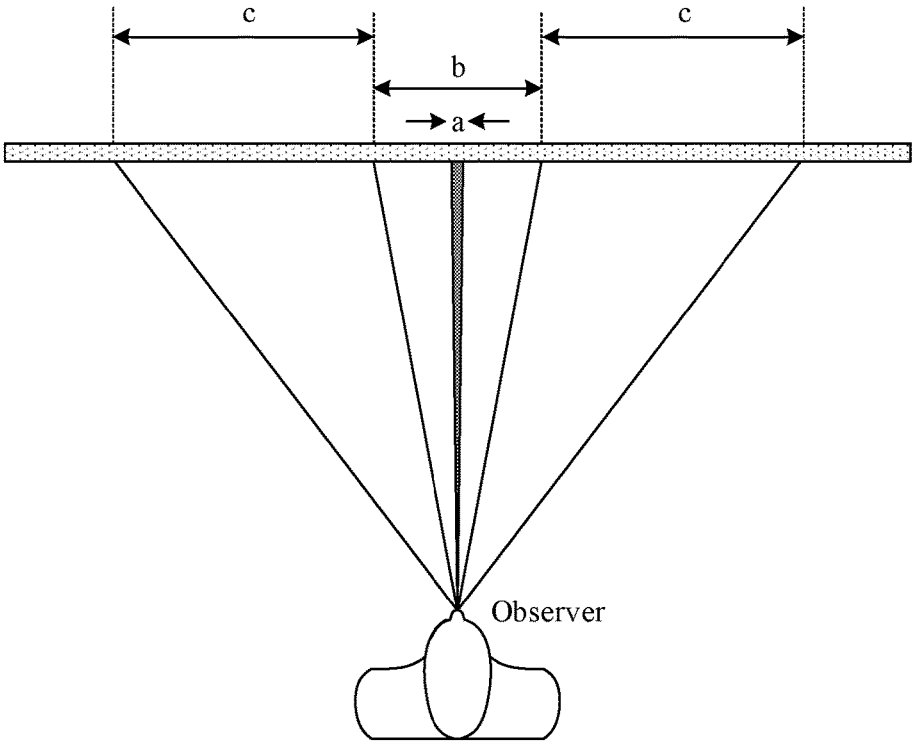
FIG. 1 is a schematic diagram of a fixation region and a non-fixation region in a display screen.

Embodiments of the present disclosure will be described in detail hereinafter with reference to the accompanying drawings. It should be noted that the embodiments may be implemented in a number of different forms. Those of ordinary skills in the art will readily understand the fact that implementations and contents may be transformed into a variety of forms without departing from the spirit and scope of the present disclosure. Therefore, the present disclosure should not be construed as being limited only to what is described in the following embodiments. The embodiments and features in the embodiments in the present disclosure may be combined randomly if there is no conflict.

In the accompanying drawings, sizes of constituent elements and thicknesses and regions of layers are sometimes exaggerated for clarity. Therefore, an implementation of the present disclosure is not necessarily limited to the sizes shown. The shapes and sizes of components in the accompanying drawings do not reflect true proportions. In addition, the drawings schematically show ideal examples, and an implementation of the present disclosure is not limited to the shapes or numerical values shown in the drawings.

The ordinal numbers "first", "second", "third" and the like in this specification are used to avoid confusion between constituent elements, but not to constitute limitations on quantities.

In this specification, for sake of convenience, wordings such as "central", "upper", "lower", "front", "rear", "vertical", "horizontal", "top", "bottom", "inner", "outer" and the like describe the orientation or positional relations between constituent elements with reference to the drawings, which are only for ease of description of this specification and for simplification of the description, rather than indicating or implying that the apparatus or element referred to must have a specific orientation, or must be constructed and operated in a particular orientation, and therefore may not be construed as limitations on the present disclosure. The positional relations of the constituent elements may be appropriately changed according to the direction in which each constituent element is described. Therefore, they are not limited to the wordings in the specification, and may be replaced appropriately according to the situations.

In this specification, terms "install", "connect" and "couple" shall be understood in a broad sense unless otherwise explicitly specified and defined. For example, a connection may be a fixed connection, or may be a detachable connection, or an integrated connection; it may be a mechanical connection, or may be an electrical connection; it may be a direct connection, or may be an indirect connection through middleware, or may be an internal connection between two elements. Those of ordinary skills in the art may understand the specific meanings of the above mentioned terms in the present disclosure according to specific context.

In this specification, a transistor refers to an element including at least three terminals, namely a gate electrode, a drain electrode and a source electrode. The transistor has a channel region between the drain electrode (a drain electrode terminal, a drain region or a drain electrode) and the source electrode (a source electrode terminal, a source region or a source electrode), and a current may flow through the drain electrode, the channel region and the source electrode. It should be noted that in this specification, the channel region refers to a region through which current mainly flows.

In this specification, a first electrode may be a drain electrode and a second electrode may be a source electrode, or the first electrode may be a source electrode and the second electrode may be a drain electrode. The functions of the "source electrode" and that of the "drain electrode" are interchangeable under circumstances where transistors with opposite polarities are used or where the current direction changes during circuit operation. Therefore, in this specification, "source electrode" and "drain electrode" are interchangeable.

In this specification, an "electrical connection" includes a case where constituent elements are connected together through an element with a certain electric action. The "element having a certain electrical action" is not particularly limited as long as it may transmit and receive electrical signals between connected constituent elements. Examples of the "elements having a certain electrical function" include not only electrodes and wirings, but also switching elements such as transistors, resistors, inductors, capacitors, and other elements having various functions.

In this specification, "parallel" refers to a state in which two straight lines form an angle above −10 degrees and below 10 degrees, and thus also includes a state in which the angle is above −5 degrees and below 5 degrees. In addition, "vertical" refers to a state in which two straight lines form an angle between 80 degrees and 100 degrees and thus, includes a state in which the angle is between 85 and 95 degrees.

In this specification, "film" and "layer" may be interchangeable. For example, sometimes "conductive layer" may be replaced by "conductive film". Similarly, "insulating film" may sometimes be replaced by "insulating layer".

In the present disclosure, "about" means that there is no strict limit for a value, and values within a range of process and measurement errors are allowable.

Based on saving system resources of a display apparatus and increasing a sense of presence in SmartView, a display mode of reducing resolution or refresh rate is proposed. FIG. 1 is a schematic diagram of a fixation region and a non-fixation region in a display screen. As shown in FIG. 1, when an observer (or a viewer) gazes at a display screen, the display screen may be at least divided into a fixation region b and a non-fixation region c, a fixation point a of human eyes is located in the fixation region b and the non-fixation region c is located outside the fixation region b. Generally, the fixation point is about 3°, the fixation region b is less than 30°, and the non-fixation region c is about 20° to 100°. As for the fixation region b, the observer's attention is concentrated, so that the observer may watch naturally without moving his head, and may effectively process viewed picture information. As for the non-fixation region c, with an expansion of the region, the observer gradually loses an ability to recognize objects in the picture, and even may only perceive the existence of the objects, but may not judge what objects they are. The display mode of reducing resolution is to use Face/Eye tracking technology to track positions of the observer and fixation point, configure the fixation region b to have high resolution or a high refresh rate, configure display resolution of the non-fixation region c to be smaller than the display resolution of the fixation region b, or configure a refresh rate of the non-fixation region c to be smaller than that of the fixation region b. The data volume is reduced and system resources of the display apparatus are saved by reducing the display resolution or refresh rate of the non-fixation region c. In addition, based on a supportable bandwidth and an upper limit of pixel charging time, some system resources saved by the non-fixation region c may be allocated to the fixation region b to improve the display resolution or refresh rate (frame rate) of the fixation region b.

Based on the display mode of reducing refresh rate, a display apparatus with system terminal control mode to implement refresh rate switch is proposed. Since the scheme may only be partitioned in sub-pixel rows, there is still a large system resource occupation and a large power consumption loss.

To this end, an embodiment of the present disclosure further provides a display apparatus. In an exemplary embodiment, the display apparatus may include a vision tracking device, a control circuit and a display panel, and the control circuit is respectively connected to a vision tracking circuit and the display panel. The visual tracking device is configured to acquire a fixation position of a viewer on the display panel, and determine sub-pixels in a fixation region and sub-pixels in a non-fixation region in the display panel according to the fixation position; the control circuit is configured to control the refresh rate of the sub-pixels in the fixation region to be greater than that of the sub-pixels in the non-fixation region.

In an exemplary embodiment, the vision tracking circuit may include a camera and a processing circuit. The processing circuit processes images of human faces or eyes collected by the camera to acquire a fixation position of a viewer on the display panel, and divides the display panel into a fixation region and a non-fixation region according to the fixation position, thereby determining sub-pixels included in the fixation region (i.e., the sub-pixels in the fixation region) and sub-pixels included in the non-fixation region (i.e., the sub-pixels in the non-fixation region). Then, the vision tracking circuit sends information including positions of the sub-pixels in the fixation region and positions of the sub-pixels in the non-fixation region to the control circuit.

In an exemplary embodiment, after the control circuit receives the position information of the sub-pixels in fixation region and the sub-pixels in the non-fixation region, the refresh rate of the sub-pixels in the fixation region and the sub-pixels in the non-fixation region may be controlled through corresponding control circuits and control lines, so that the refresh rate of the sub-pixels in the fixation region is greater than that of the sub-pixels in the non-fixation region.

In an exemplary embodiment, the display panel may include a display region and a circuit region, where the circuit region is located on one or more sides of the display region, and the control circuit in the display apparatus may be disposed in the circuit region of the display panel.

In an exemplary embodiment, the circuit region may include a gate circuit region located on one or both sides of the display region in a horizontal direction and a source circuit region located on one or both sides of the display region in a vertical direction.

In an exemplary embodiment, the control circuit may include a gate drive circuit and a first control circuit located in the gate circuit region, and the gate drive circuit and the first control circuit together control the refresh rates of the sub-pixels in the fixation region and the sub-pixels in the non-fixation region.

In an exemplary embodiment, the control circuit may include a gate drive circuit and a first control circuit located in the gate circuit region and a second control circuit located in the source circuit region, and the gate drive circuit, the first control circuit and the second control circuit together control the refresh rates of the sub-pixels in the fixation region and the sub-pixels in the non-fixation region.

In an exemplary embodiment, the control circuit may include a gate drive circuit located in the gate circuit region and a second control circuit located in the source circuit region, and the gate drive circuit and the second control circuit together control the refresh rates of the sub-pixels in the fixation region and the sub-pixels in the non-fixation region.

In an exemplary embodiment, the control circuit may further include a scan control circuit connected to the gate drive circuit, and the scan control circuit is configured to provide an initial signal or a reset signal to the gate drive circuit to scan a part of sub-pixel rows in a frame of display.

In an exemplary embodiment, the display panel may include a plurality of scan signal lines, a plurality of data signal lines and a plurality of sub-pixels; at least one sub-pixel includes switch assembly and a display unit, wherein the switch assembly at least includes a control terminal, an input terminal and an output terminal, wherein the input terminal is connected to the data signal line, the output terminal is connected to the display unit, and the control terminal or the input terminal is connected to the scan signal line; the display panel further includes at least one switch control line connected to the control terminal of the switch assembly, the switch control line is configured to control a conduction of an input terminal and an output terminal of the switch assembly according to a control signal output by the control circuit, so that the data signals are refreshed in the sub-pixels, or to control the input terminal and the output terminal of the switch assembly to be turned off, so that the data signals are not refreshed in the sub-pixels.

In an exemplary embodiment, the control terminal of the switch assembly includes a first control terminal and a second control terminal, the switch assembly includes a first transistor and a second transistor, and the switch control line includes a first control line. The gate electrode of the first transistor serves as the first control terminal of the switch assembly, and the gate electrode of the second transistor serves as the second control terminal of the switch assembly. A first electrode of the first transistor serves as an input terminal of the switch assembly, and a second electrode of the second transistor serves as an output terminal of the switch assembly. The gate electrode of the first transistor is connected to the scan signal line, the gate electrode of the second transistor is connected to the first control line, the first electrode of the first transistor is connected to the data signal line, and the second electrode of the first transistor is connected to the first electrode of the second transistor, the second electrode of the second transistor is connected to a display unit. Wherein, the scan signal line is connected to the gate drive circuit, and the first control line is connected to the first control circuit. The gate drive circuit controls on or off of the first transistor through the scan signal line, and the first control circuit controls on or off of the second transistor through the first control line, so that the sub-pixels may refresh or not refresh the data signals.

In an exemplary embodiment, the control terminal of the switch assembly includes a first control terminal, a second control terminal and a third control terminal, the switch assembly includes a first transistor, a second transistor and a third transistor, and the switch control line includes a first control line and a second control line. The gate electrode of the first transistor serves as the first control terminal of the switch assembly, the gate electrode of the second transistor serves as the second control terminal of the switch assembly, and the gate electrode of the third transistor serves as the third control terminal of the switch assembly. A first electrode of the first transistor serves as an input terminal of the switch assembly, and a second electrode of the third transistor serves as an output terminal of the switch assembly. The gate electrode of the first transistor is connected to a scan signal line, the gate electrode of the second transistor is connected to the first control line, the gate electrode of the third transistor is connected to the second control line, the first electrode of the first transistor is connected to a data signal line, the second electrode of the first transistor is connected to the first electrode of the second transistor, the second electrode of the second transistor is connected to the first electrode of the third transistor, and the second electrode of the third transistor is connected to a display unit. Wherein, the scan signal line is connected to a gate drive circuit, the first control line is connected to the first control circuit, the second control line is connected to the second control circuit, and the gate drive circuit controls on or off of the first transistor through the scan signal line; the first control circuit controls on or off of the second transistor through the first control line, and the second control circuit controls on or off of the third transistor through the second control line, so that sub-pixels may refresh or not refresh the data signals.

In an exemplary embodiment, the control terminal of the switch assembly includes a first control terminal, the switch assembly includes a fourth transistor and a fifth transistor, and the switch control line includes a second control line. The gate electrode of the fourth transistor serves as the first control terminal of the switch assembly, the first electrode of the fifth transistor serves as an input terminal of the switch assembly, and the second electrode of the fifth transistor serves as an output terminal of the switch assembly. The gate electrode of the fourth transistor is connected to the second control line, the first electrode of the fourth transistor is connected to the scan signal line, the second electrode of the fourth transistor is connected to the gate electrode of the fifth transistor, the first electrode of the fifth transistor is connected to the data signal line and the second electrode of the fifth transistor is connected to the display unit. Wherein, the scan signal line is connected to the gate drive circuit, and the second control line is connected to the second control circuit. The gate drive circuit controls on or off of the fourth transistor through the scan signal line, and the second control circuit controls on or off of the fifth transistor through the second control line, so that the sub-pixels may refresh or not refresh the data signals.

In an exemplary embodiment, the display panel may be an LCD display panel, and the display unit may include pixel electrodes. A pixel electrode and a common electrode form an electric field that drives a deflection of a liquid crystal.

In an exemplary embodiment, the display panel may be an OLED display panel, and the display unit may include a pixel circuit and a light emitting device. The pixel circuit may have a drive circuit structure such as 2T1C, 3T1C, 4T1C, 5T1C, 6T1C or 7T1C, and the light emitting device may include an anode, an organic light emitting layer and a cathode.

Figure 2:
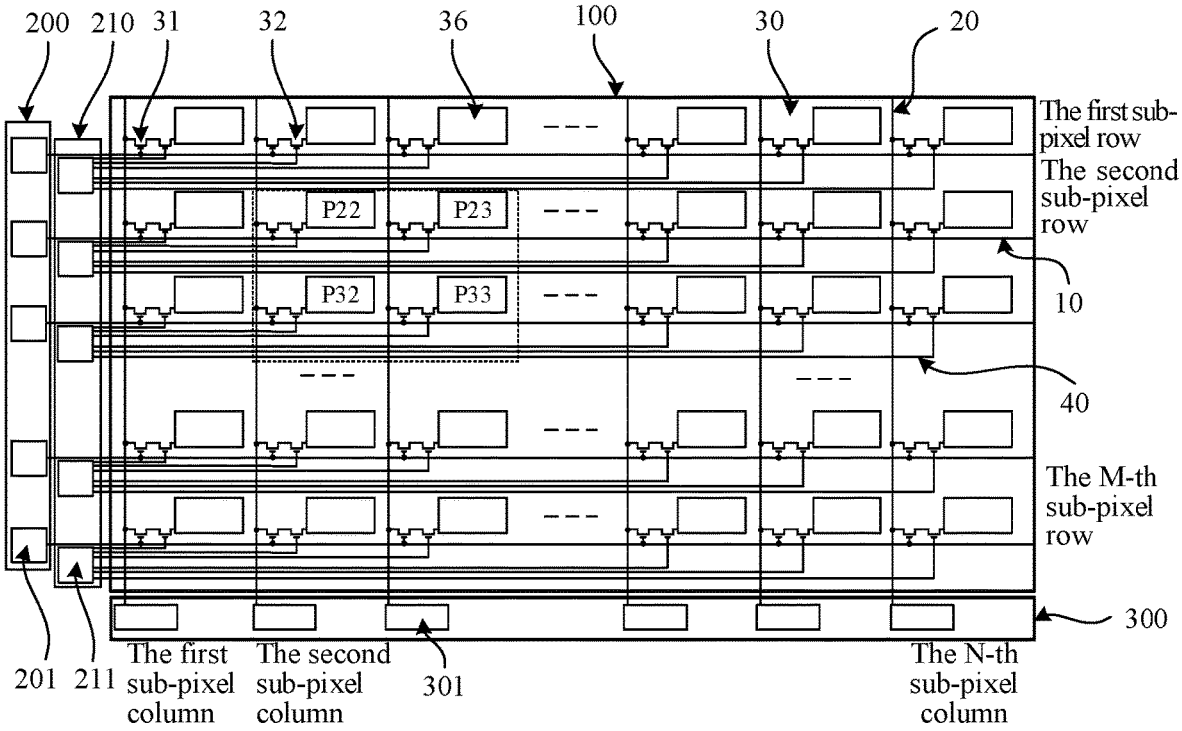
FIG. 2 is a schematic diagram of a structure of a display apparatus according to an exemplary embodiment of the present disclosure.

FIG. 2 is a schematic diagram of a structure of a display apparatus according to an exemplary embodiment of the present disclosure. As shown in FIG. 2, the display apparatus at least includes a display panel and a control circuit, and an LCD display panel is taken as an example of the display panel. In an exemplary embodiment, a display panel 100 may include M scan signal lines 10 extending in a horizontal direction and N data signal lines 20 extending in a vertical direction, and the M scan signal lines 10 and the N data signal lines 20 intersect with each other to form M*N sub-pixels 30 arranged in a matrix. The M*N sub-pixels 30 arranged in a matrix include M sub-pixel rows and N sub-pixel columns, where M and N are positive integers greater than or equal to 2. The intersections of the scan signal lines and the data signal lines according to the exemplary embodiment of the present disclosure refer to that projections of the scan signal lines and the data signal lines on the substrate intersect vertically, but there is no direct contact between the scan signal lines and the data signal lines due to an existence of insulating layers.

In an exemplary embodiment, the display panel 100 may further include M first control lines 40 as switch control lines, and the first control lines 40 may be disposed between adjacent sub-pixel rows. In an exemplary embodiment, a first control line 40 may be parallel to a scan signal line.

In an exemplary embodiment, at least one sub-pixel 30 may include a first transistor 31, a second transistor 32 and a pixel electrode 36, wherein the pixel electrode 36 serves as a display unit, and the first transistor 31 and the second transistor 32 serve as switch assembly. A gate electrode of the first transistor 31 serves as a first control terminal of the switch assembly, and a gate electrode of the second transistor 32 serves as a second control terminal of the switch assembly. A first electrode of the first transistor 31 serves as an input terminal of the switch assembly, and a second electrode of the second transistor 32 serves as an output terminal of the switch assembly. The gate electrode of the first transistor 31 is connected to a scan signal line 10, the first electrode of the first transistor 31 is connected to a data signal line 20, and a second electrode of the first transistor 31 is connected to a first electrode of the second transistor 32. The gate electrode of the second transistor 32 is connected to the first control line 40, and the second electrode of the second transistor 32 is connected to the pixel electrode 36.

In an exemplary embodiment, the control circuit may include a gate drive circuit 200, a source drive circuit 300 and a first control circuit 210, wherein the gate drive circuit 200 is connected to M scan signal lines 10, the first control circuit 210 is connected to M first control lines 40 and the source drive circuit 300 is connected to N data signal lines 20.

In an exemplary embodiment, a gate drive circuit 200 may include M gate drive modules 201 which are connected to M scan signal lines 10 in an one-to-one correspondence. A first control circuit 210 may include M first control modules 211 which are connected to M first control lines 40 in an one-to-one correspondence. A source drive circuit 300 may include N source drive modules 301 which are connected to N data signal lines 20 in an one-to-one correspondence.

In an exemplary embodiment, a gate drive module 201 may be an array substrate row drive (such as Gate Driver on Array, GOA) unit, and one gate drive module 201 is connected to a scan signal line 10 in a sub-pixel row in the display region 100, and provides a first on signal for the scan signal line 10, thereby controlling on and off of first transistors 31 of N sub-pixels in the sub-pixel row. M gate drive modules 201 in the gate drive circuit 200 are connected in a cascade manner, and an output signal of a previous gate drive module 201 serves as an input signal of a current gate drive module 201.

In an exemplary embodiment, a first end of a scan signal line 10 in a sub-pixel row is connected to an output terminal of a gate drive module 201, and a second end extends in a horizontal direction and is connected to gate electrodes of first transistors 31 of N sub-pixels, so that the first transistors 31 of all sub-pixels in the sub-pixel row are simultaneously turned on or off.

In an exemplary embodiment, a source drive module 301 may be a source drive (such as Source IC) unit, and one source drive module 301 and a data signal line 20 in a sub-pixel column in the display region 100 provide data signals for a data signal line 20, so that the data signal line 20 outputs data signals to first electrodes of first transistors 31 in M sub-pixels in the sub-pixel column.

In an exemplary embodiment, a first control module 211 may be a switch (SW) unit, and one first control module 211 is connected to a first control line 40 in a sub-pixel row in the display region 100, and provides a second on signal or off signal for the first control line 40, thereby controlling the on and off of a second transistor 32 of a corresponding sub-pixels in the sub-pixel row.

In an exemplary embodiment, a first control line 40 corresponding to a sub-pixel row may include N sub-control lines, i.e., a first sub-control line, a second sub-control line, . . . , (N−1)th sub-control line and a N-th sub-control line. A first end of the first sub-control line is connected to a first control module 211, and a second end extends in a horizontal direction and is connected to a gate electrode of a second transistor 32 of a first sub-pixel column. A first end of the second sub-control line is connected to a first control module 211, and a second end extends in a horizontal direction and is connected to a gate electrode of a second transistor 32 of a second sub-pixel column . . . . A first end of the N-th sub-control line is connected to a first control module 211, and a second end extends in a horizontal direction and is connected to a gate electrode of a second transistor 32 of the N-th sub-pixel column. In this way, second transistors 32 of N sub-pixels in a sub-pixel row may be independently controlled by a first control module 211 through a sub-control line, that is, a first control module 211 may independently control on and off of a second transistor 32 of a corresponding sub-pixel.

In an exemplary embodiment, the display panel may include a fixation region and a non-fixation region. Sub-pixels in the fixation region are called sub-pixels of the fixation region and sub-pixels in the non-fixation region are called sub-pixels of the non-fixation region. In an exemplary embodiment, sub-pixels of the fixation region (as shown in a dashed box in FIG. 2) may include a first sub-pixel P22, a second sub-pixel P23, a third sub-pixel P32 and a fourth sub-pixel P33, and sub-pixels outside the fixation region are sub-pixels of the non-fixation region. Wherein, the first sub-pixel 22 is located in a second sub-pixel column in a second sub-pixel row, the second sub-pixel P23 is located in a third sub-pixel column in a second sub-pixel row, the third sub-pixel P32 is located in a second sub-pixel column in a third sub-pixel row, and the fourth sub-pixel P33 is located in a third sub-pixel column in a third sub-pixel row.

Next, two frames of display is taken as an example to illustrate a drive process of the display panel of the exemplary embodiment.

1. In a first frame of display, scan signal lines 10 and first control lines 40 of M sub-pixel rows provide on signals row by row, and data signal lines 20 of N sub-pixel columns provide data signals to refresh data signals of all sub-pixels of the display panel.

In an exemplary embodiment, in an i-th scan period, a gate drive module 201 corresponding to an i-th sub-pixel row provides a first on signal, and a first control module 211 provides a second on signal. The first on signal is transmitted to first transistors 31 of N sub-pixels through scan signal lines, so that the first transistors 31 of the N sub-pixels are simultaneously turned on. The second on signal is transmitted to second transistors 32 of the N sub-pixels through N sub-control lines (first control lines 40), so that the second transistors 32 of the N sub-pixels are simultaneously turned on. Since first transistors 31 and second transistors 32 of all sub-pixels in the i-th sub-pixel row are turned on, that is, input and output terminals of the switch assembly are turned on, data signals are transmitted to a pixel electrode 36 through the turned-on first transistor 31 and second transistor 32, and all the sub-pixels in the i-th sub-pixel row refresh data signals. Wherein, the scan period refers to scan time of a sub-pixel row, i=1, 2, 3, . . . , m.

2. In a second frame of display, a gate drive module 201 corresponding to M sub-pixel rows provides first on signals row by row, and the first control module 211 provides second on signals or off signals accordingly, so as to refresh data signals of sub-pixels in the fixation region in the display panel.

In a first scan period, a first sub-pixel row does not include the sub-pixels in the fixation region, and a gate drive module 201 corresponding to the first sub-pixel row provides first on signals, and the first control module 211 provides off signals. The first on signals are transmitted to the first transistors 31 of the N sub-pixels through the scan signal line 10 to turn on the first transistors 31 of the N sub-pixels. The off signals are transmitted to the second transistors 32 of the N sub-pixels through N sub-control lines to turn off the second transistors 32 of the N sub-pixels. Because the second transistors 32 of all the sub-pixels of the first sub-pixel row are turned off, that is, input and output terminals of the switch assembly are turned off, all the sub-pixels of the first sub-pixel row do not refresh data signals. In the first scan period, because all the sub-pixels of the first sub-pixel row do not refresh the data signals, source drive circuits do not need to output data signals.

In a second scan period, a second sub-pixel row includes sub-pixels of the fixation region, and a gate drive module 201 corresponding to the second sub-pixel row provides first on signal, and the first control module 211 provides second on signal and off signal. The first on signal is transmitted to the first transistors 31 of the N sub-pixels through the scan signal line 10 to turn on the first transistors 31 of the N sub-pixels. The second on signal is transmitted to the second transistor 32 of the first sub-pixel P22 through a second sub-control line, and the second on signal is transmitted to the second transistor 32 of the second sub-pixel P23 through a third sub-control line to turn on the second transistors 32 of the two sub-pixels. The off signal is transmitted to other sub-pixels except the first sub-pixel P22 and the second sub-pixel P23 through other sub-control lines to turn off second transistors 32 of other sub-pixels except the two sub-pixels. Because the first transistor 31 and the second transistor 32 of the first sub-pixel P22 and the second sub-pixel P23 are turned on, that is, the input and output terminals of the switch assembly are turned on, thus the data signals are transmitted to the pixel electrodes 36 of the first sub-pixel P22 and the second sub-pixel P23, the first sub-pixel P22 and the second sub-pixel P23 (the sub-pixel of the fixation region) refresh the data signals. Because second transistors 32 of other sub-pixels are turned off, that is, the input and output terminals of the switch assembly are turned off, thus other sub-pixels (sub-pixels of the non-fixation region) of the second sub-pixel row do not refresh the data signals. In the second scan period, because the data signals in the first sub-pixel P22 and the second sub-pixel P23 of the second sub-pixel row are rewritten, source drive modules 301 corresponding to a second sub-pixel column and a third sub-pixel column need to output data signals. Because data signals in other sub-pixels do not need to be rewritten, source drive modules 301 corresponding to other sub-pixel columns do not need to output data signals.

In a third scan period, a third sub-pixel row includes sub-pixels in the fixation region, and a gate drive module 201 corresponding to the third sub-pixel row provides a first on signal, and the first control module 211 provides a second on signal and an off signal. The first on signal is transmitted to the first transistors 31 of the N sub-pixels through the scan signal line 10 to turn on the first transistors 31 of the N sub-pixels. The second on signal is transmitted to the second transistor 32 of the third sub-pixel P32 through the second sub-control line, and the second on signal is transmitted to the second transistor 32 of the fourth sub-pixel P33 through the third sub-control line to turn on the second transistors 32 of the two sub-pixels. The off signal is transmitted to other sub-pixels except the third sub-pixel P32 and the fourth sub-pixel P33 through other sub-control lines to turn off the second transistors 32 of other sub-pixels except the two sub-pixels. Since the first transistor 31 and the second transistor 32 of the third sub-pixel P32 and the fourth sub-pixel P33 are turned on, that is, the input and output terminals of the switch assembly are turned on, data signals provided by a data signal line 20 are transmitted to the pixel electrodes 36 of the third sub-pixel P32 and the fourth sub-pixel P33, the data signals for the third sub-pixel P32 and the fourth sub-pixel P33 (sub-pixels of the fixation region) are refreshed. Because second transistors 32 of other sub-pixels are turned off, that is, the input and output terminals of the switch assembly are turned off, the data signals for other sub-pixels (sub-pixels of the non-fixation region) of the second sub-pixel row are not refreshed. In the second scan period, the source drive modules 301 corresponding to the second and third sub-pixel columns need to output data signals, while source drive modules 301 corresponding to other sub-pixel columns do not need to output data signals.

From a fourth scan period to an M-th scan period, a fourth sub-pixel row to an M-th sub-pixel row does not include sub-pixels of the fixation region, and the drive process is the same as that in the first scan period. Although the gate drive module 201 provides the first on signals row by row through the scan signal line 10, however because the first control module 211 provides the off signals row by row through the first control line 40, data signals in all the sub-pixels from the fourth sub-pixel row to the M-th sub-pixel row are not refreshed, and the source drive circuit does not need to output the data signals.

In an exemplary embodiment, in subsequent pictures of display, a drive process of displaying odd frames is the same as that of displaying the first frame, and a drive process of displaying even frames is the same as that of displaying the second frame, which will not be repeatedly described here.

It may be seen from the drive process of the display panel in this exemplary embodiment that during the time of the two-frame display, the sub-pixels of the fixation region have experienced two data signal refreshes, and the sub-pixels of the non-fixation region have experienced one data signal refresh, so a refresh rate of the sub-pixels of the fixation region is twice that of the sub-pixels of the non-fixation region. For example, the refresh rate of the sub-pixels of the fixation region is 80 Hz, and the refresh rate of the sub-pixels of the non-fixation region is 40 Hz.

According to an exemplary embodiment of the present disclosure, two transistors are disposed in a sub-pixel, and only when a first transistor and a second transistor in the sub-pixel are simultaneously turned on, a data signal for the sub-pixel may be refreshed, thus a partition refresh of the display panel is achieved, and there are different refresh rates for sub-pixels of the fixation region and sub-pixels of the non-fixation region. Because a gate drive module is used to control on and off of a first transistor through a scan signal line, and a first control module is used to control on and off of a second transistor through the first control line, therefore the display panel may be partitioned arbitrarily, and the fixation region may be located at any position of the display panel. During the time of two-frame display, only data signals of sub-pixels of the fixation region are refreshed twice, while data signals of sub-pixels of the non-fixation region are refreshed only once, that is, only source drive module of sub-pixel columns where sub-pixels of the fixation region are located provides data signals twice, while other source drive modules only need to provide data signals once, thus effectively reducing the quantity of data signals provided by source drive circuits, effectively saving system resources for processing and transmitting data signals and effectively reducing system power consumption.

Figure 3:
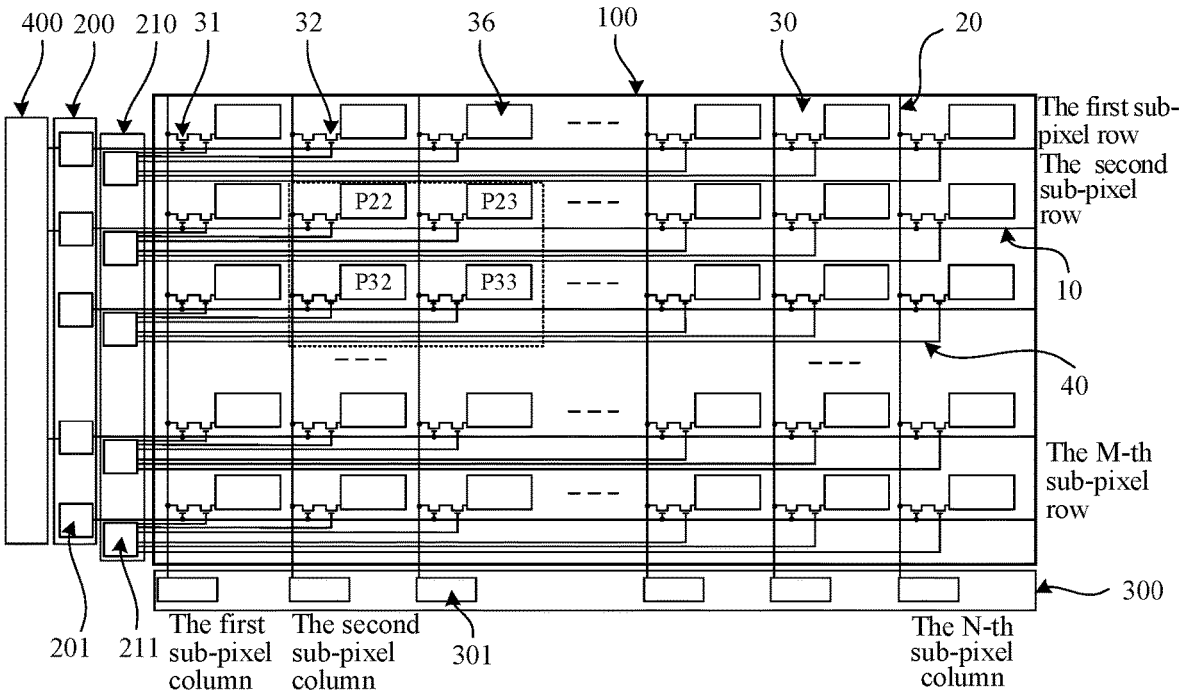
FIG. 3 is a schematic diagram of a structure of another display apparatus according to an exemplary embodiment of the present disclosure.

FIG. 3 is a schematic diagram of a structure of another display apparatus according to an exemplary embodiment of the present disclosure. As shown in FIG. 3, on the basis of the display apparatus shown in FIG. 2, the display apparatus of this exemplary embodiment may further include a scan control circuit 400, which is connected to a gate drive circuit 200 and configured to provide an initial signal or a reset signal to the gate drive circuit 200, so as to scan a part of sub-pixel rows in a frame of display.

Next, two frames of display is taken as an example to illustrate a drive process of the display panel of the exemplary embodiment.

1. In a first frame of display, scan signal lines 10 and first control lines 40 of M sub-pixel rows provide on signals row by row to refresh data signals of all sub-pixels of the display panel, which is the same as the structure for the process of the first frame display shown in FIG. 2.

2. In a second frame of display, a second sub-pixel row includes sub-pixels of the fixation region. The scan control circuit 400 provides an initial (STV) signal to a gate drive module 201 corresponding to a second sub-pixel row, the gate drive module 201 corresponding to the second sub-pixel row provides a first on signal and a first control module 211 provides a second on signal and off signal. The first on signal simultaneously turns on first transistors 31 of N sub-pixels, the second on signal turns on second transistors 32 of a first sub-pixel P22 and a second sub-pixel P23 in the fixation region, and the off signal turns off second transistors 32 of other sub-pixels. In this way, data signals for the first sub-pixel P22 and the second sub-pixel P23 in the fixation region are refreshed, while the data signals for other sub-pixels in the second sub-pixel row are not refreshed.

In a next scan period, a third sub-pixel row includes sub-pixels in the fixation region, and a gate drive module 201 corresponding to the third sub-pixel row provides a first on signal, and the first control module 211 provides a second on signal and an off signal. The first on signal simultaneously turns on first transistors 31 of N sub-pixels, the second on signal turns on second transistors 32 of a third sub-pixel P32 and a fourth sub-pixel P33 in the fixation region, and the off signal turns off second transistors 32 of other sub-pixels. In this way, data signals for the third sub-pixel P32 and the fourth sub-pixel P33 in the fixation region are refreshed, while the data signals for other sub-pixels in the second sub-pixel row are not refreshed.

In a next period, a fourth sub-pixel row to a M-th sub-pixel row do not include sub-pixels of the fixation region, and the scan control circuit 400 provides a Total_reset signal to a gate drive module 201 corresponding to the fourth sub-pixel row, so that the gate drive modules 201 and the first control modules 211 in the fourth sub-pixel row to the M-th sub-pixel row stop providing control signals, and the second frame is in a Blank time.

In an exemplary embodiment, in subsequent pictures of display, a drive process of displaying odd frames is the same as that of displaying the first frame, and a drive process of displaying even frames is the same as that of displaying the second frame, which will not be repeatedly described here.

It may be seen from the drive process of the display panel in this exemplary embodiment that in this exemplary embodiment, not only a partition refresh and an arbitrary partition of the display panel may be achieved, which effectively saves system resources for processing and transmitting data signals, but also scans for partial sub-pixel rows in a frame of display may be achieved by disposing scan control circuits, which increases the frame blank time, saves the system resources for processing and transmitting scan signals by the gate drive circuit, further saves the system resources and further reduces the system power consumption.

In an exemplary embodiment, the display panel may be divided into n sub-regions arranged in sequence along a vertical direction, each sub-region includes a plurality of sub-pixel rows, and n is a positive integer greater than or equal to 2 and smaller than or equal to M. Accordingly, a gate drive circuit may be divided into n sub-circuits, and each sub-circuit includes a plurality of gate drive modules. In an exemplary embodiment, the scan control circuit 400 may be connected to a first gate drive module in at least one sub-circuit, and when a frame is displayed, the scan control circuit only scans a set sub-region by providing an initial signal or a reset signal to the sub-circuit.

Figure 4A:
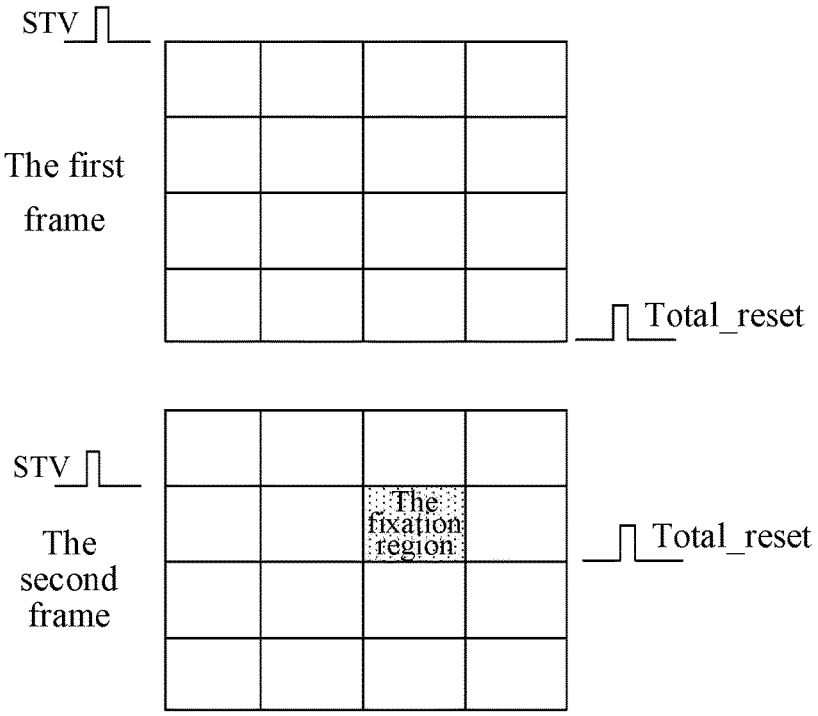
FIG. 4A is a schematic diagram of a drive mode of a scan control circuit according to an exemplary embodiment of the present disclosure.

FIG. 4A is a schematic diagram of a drive mode of a scan control circuit according to an exemplary embodiment of the present disclosure; As shown in FIG. 4A, when the first frame is displayed, an STV signal is provided at the beginning of scanning a first sub-pixel row, the scan signal lines of M sub-pixel rows provide on signals row by row, and provide the Total_reset signal at the end of scanning the M-th sub-pixel row, thus entering the blank time of this frame. When the second frame is displayed, an STV signal is provided at the beginning of scanning sub-pixel rows containing the fixation region, then scan signal lines of each sub-pixel row containing the fixation region provide on signals row by row, and provide the Total_reset signal at the end of scanning sub-pixel rows containing the fixation region, thus entering the blank time of this frame. In this drive mode, the second frame only scans each sub-pixel row containing the fixation region.

Figure 4B:
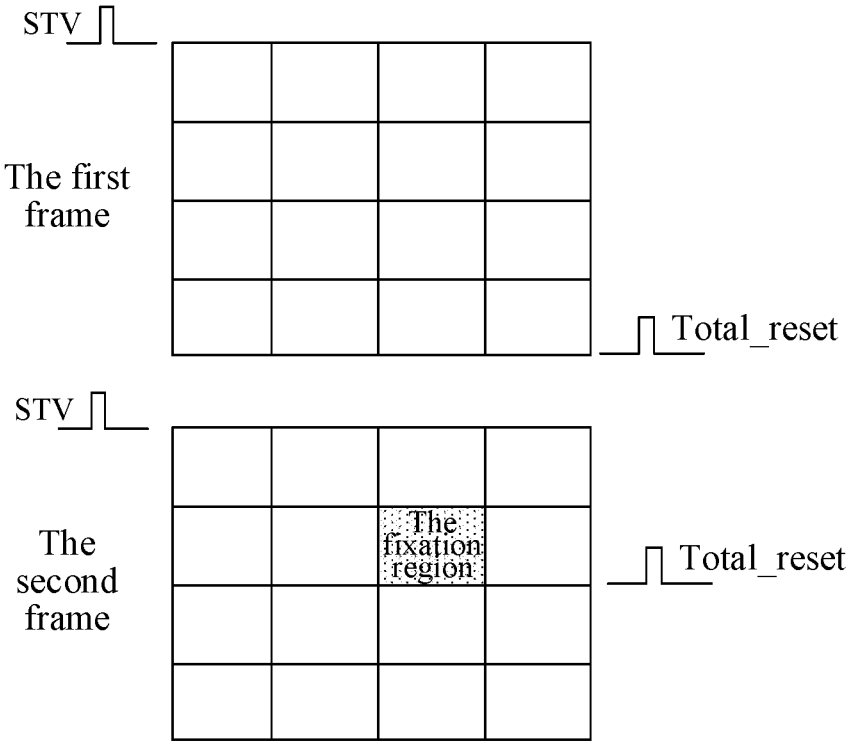
FIG. 4B is a schematic diagram of another drive mode of the scan control circuit according to an exemplary embodiment of the present disclosure.

FIG. 4B is a schematic diagram of another drive mode of the scan control circuit according to an exemplary embodiment of the present disclosure. As shown in FIG. 4B, when the first frame is displayed, an STV signal is provided at the beginning of scanning a first sub-pixel row, the scan signal lines of M sub-pixel rows provide on signals row by row, and provide the Total_reset signal at the end of scanning the M-th sub-pixel row, thus entering the blank time of this frame. When the second frame is displayed, an STV signal is provided at the beginning of scanning the first sub-pixel row, then scan signal lines of M sub-pixel rows provide on signals row by row, and provide the Total_reset signal at the end of scanning the sub-pixel rows containing the fixation region, thus entering the blank time of this frame. In this drive mode, a scan for the second frame is only operated till the end of the fixation region.

Figure 4C:
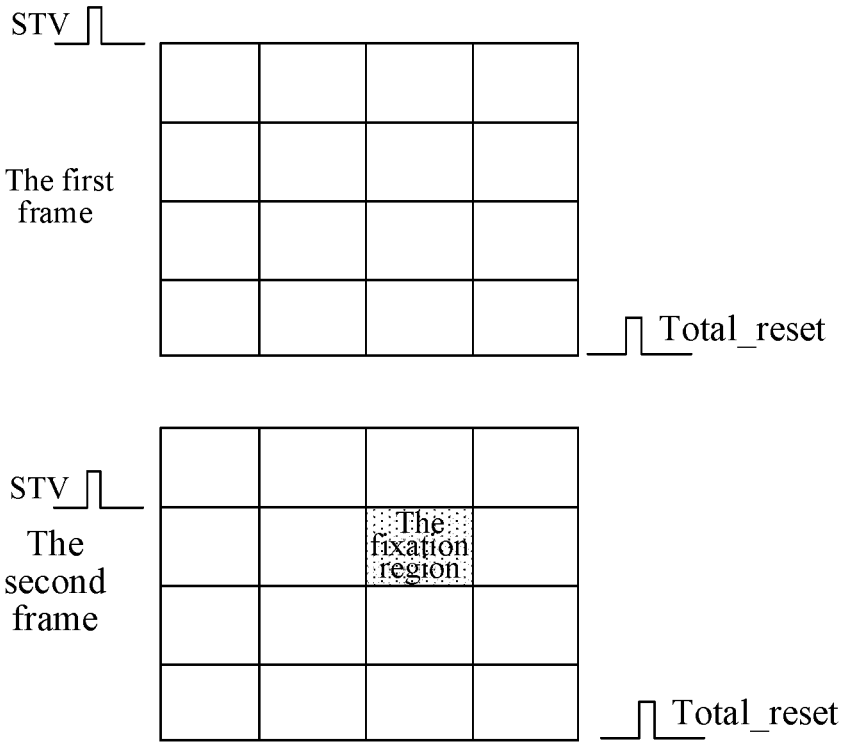
FIG. 4C is a schematic diagram of another drive mode of the scan control circuit according to an exemplary embodiment of the present disclosure.

FIG. 4C is a schematic diagram of another drive mode of the scan control circuit according to an exemplary embodiment of the present disclosure. As shown in FIG. 4C, when the first frame is displayed, an STV signal is provided at the beginning of scanning the first sub-pixel row, the scan signal lines of M sub-pixel rows provide on signals row by row, and provide the Total_reset signal at the end of scanning the M-th sub-pixel row, thus entering the blank time of this frame. When the second frame is displayed, an STV signal is provided at the beginning of scanning sub-pixel rows containing the fixation region, then scan signal lines of each sub-pixel row provide on signals row by row, and provide the Total_reset signal at the end of scanning the M-th sub-pixel row, thus entering the blank time of this frame. In this drive mode, a scan for the second frame starts only from the fixation region.

In an exemplary embodiment, the scan control circuit may determine whether to forward scan or reverse scan according to a position of the fixation region. For example, if the fixation region is located in an upper half of the display panel, then the scan control circuit controls the gate drive circuit to forward scan. For another example, if the fixation region is located in a lower half of the display panel, then the scan control circuit controls the gate drive circuit to reverse scan.

Figure 5:
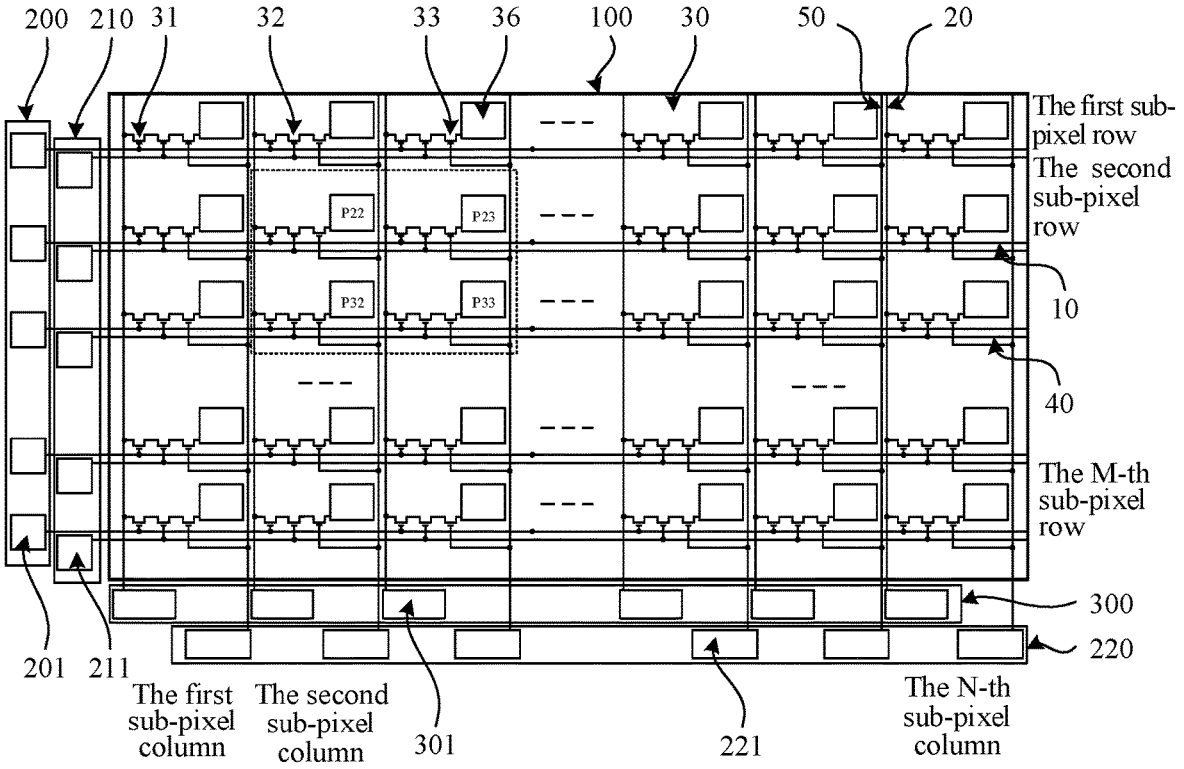
FIG. 5 is a schematic diagram of a structure of a display apparatus according to an exemplary embodiment of the present disclosure.

FIG. 5 is a schematic diagram of a structure of another display apparatus according to an exemplary embodiment of the present disclosure. As shown in FIG. 5, the display apparatus at least includes a display panel and a control circuit, and an LCD display panel is taken as an example of the display panel. In an exemplary embodiment, the display panel 100 may include M scan signal lines 10, N data signal lines 20 and M*N sub-pixels 30. The display panel 100 may further include M first control lines 40 and N second control lines 50 as switch control lines, the first control lines 40 may be disposed between adjacent sub-pixel rows and the second control lines 50 may be disposed between adjacent sub-pixel columns. In an exemplary embodiment, a first control line 40 may be parallel to a scan signal line, and a second control line 50 may be parallel to the data signal line.

In an exemplary embodiment, at least one sub-pixel 30 may include a first transistor 31, a second transistor 32, a third transistor 33 and a pixel electrode 36, wherein the pixel electrode 36 serves as a display unit, and the first transistor 31, the second transistor 32 and the third transistor 33 serve as switch assembly. A gate electrode of the first transistor 31 serves as the first control terminal of the switch assembly, a gate electrode of the second transistor 32 serves as the second control terminal of the switch assembly, and a gate electrode of the third transistor 33 serves as the third control terminal the switch assembly. A first electrode of the first transistor 31 serves as an input terminal of the switch assembly, and a second electrode of the third transistor 33 serves as an output terminal of the switch assembly. The gate electrode of the first transistor 31 is connected to a scan signal line 10, the first electrode of the first transistor 31 is connected to a data signal line 20, and a second electrode of the first transistor 31 is connected to a first electrode of the second transistor 32. The gate electrode of the second transistor 32 is connected to the first control line 40, and a second electrode of the second transistor 32 is connected to a first electrode of the third transistor 33. The gate electrode of the third transistor 33 is connected to the second control line 50, and the second electrode of the third transistor 33 is connected to the pixel electrode 36.

In an exemplary embodiment, the control circuit may include a gate drive circuit 200, a source drive circuit 300, a first control circuit 210 and a second control circuit 220, wherein the gate drive circuit 200 is connected to M scan signal lines 10, the first control circuit 210 is connected to M first control lines 40 and the source drive circuit 300 is connected to N data signal lines 20, the second control circuit 220 is connected to N second control lines 50.

In an exemplary embodiment, the gate drive circuit 200 may include M gate drive modules 201 which are connected to M scan signal lines 10 in an one-to-one correspondence. A first control circuit 210 may include M first control modules 211 which are connected to M first control lines 40 in an one-to-one correspondence. A source drive circuit 300 may include N source drive modules 301 which are connected to N data signal lines 20 in an one-to-one correspondence. The second control circuit 220 may include N second control modules 221 which are connected to N second control lines 50 in an one-to-one correspondence.

In an exemplary embodiment, a gate drive module 201 may be a GOA unit, and one gate drive module 201 is connected to a first end of a scan signal line 10 in a sub-pixel row in the display region 100, and a second end of the scan signal line 10 extends along a horizontal direction and is connected to gate electrodes of first transistors 31 in N sub-pixels in the sub-pixel row, thereby controlling the first transistors 31 of N sub-pixels to be turned on or off at the same time.

In an exemplary embodiment, a source drive module 301 may be a Source drive unit (such as Source IC), and one source drive unit is connected to a first end of a data signal line 20 in a sub-pixel column in the display region 100, an second end of the data signal line 20 extends along a vertical direction and is connected to first electrodes of first transistors 31 in M sub-pixels, so that the data signal line 20 outputs data signals to the first electrodes of the first transistors 31 in M sub-pixels in the sub-pixel column.

In an exemplary embodiment, a first control module 211 may be an SW unit, and one first control module 211 is connected to a first end of a first control line 40 in a sub-pixel row of the display region 100, and a second end of the first control line 40 extends along a horizontal direction and is connected to gate electrodes of second transistors 32 of N sub-pixels in the sub-pixel row, thereby controlling the second transistors 32 of N sub-pixels to be on or off at the same time.

In an exemplary embodiment, a second control module 221 may be an SW unit, and one second control module 221 is connected to a first end of a second control line 50 in a sub-pixel column of the display region 100, and a second end of the second control line 50 extends along a vertical direction and is connected to gate electrodes of third transistors 33 of M sub-pixels in the sub-pixel column, thereby controlling the third transistors 33 of M sub-pixels to be turned on or off at the same time.

A first sub-pixel P22, a second sub-pixel P23, a third sub-pixel P32 and a fourth sub-pixel P33 being included in sub-pixels of the fixation region of the display panel are taken as examples to describe the drive process of the display panel according to this exemplary embodiment.

1. In a first frame of display, scan signal lines 10 and first control lines 50 of M sub-pixel rows provide on signals row by row, second control lines 50 of N sub-pixel columns provide on signals and data signal lines 20 of N sub-pixel columns provide data signals to refresh data signals of all sub-pixels of the display panel.

In an exemplary embodiment, in an i-th scan period, a gate drive module 201 corresponding to an i-th sub-pixel row provides first on signals, and a first control module 211 provides second on signals. Second control modules 221 of N sub-pixel columns provide third on signals, and source drive modules 301 of N sub-pixel columns provide data signals. The first on signal is transmitted to first transistors 31 of N sub-pixels through scan signal lines, so that the first transistors 31 of the N sub-pixels are simultaneously turned on. The second on signal is transmitted to second transistors 32 of the N sub-pixels through first control lines 40, so that the second transistors 32 of the N sub-pixels are simultaneously turned on. The third on signal is transmitted to third transistors 33 of M sub-pixels through second control lines, so that the third transistors 33 of the M sub-pixels are simultaneously turned on. Because first transistors 31 and second transistors 32 and third transistors 33 of all sub-pixels in the i-th sub-pixel row are turned on, that is, input and output terminals of the switch assembly are turned on, thus data signals are transmitted to a pixel electrode 36 through the turned-on first transistor 31 and the second transistor 32 and the third transistor 33, and the data signals for all the sub-pixels in the i-th sub-pixel row are refreshed.

2. In a second frame of display, a gate drive module 201 corresponding to M sub-pixel rows provides first on signals row by row; a first control module 211 provides second on signals row by row; and a second control module 221 provides third on signals or off signals accordingly, so as to implement the refreshing for the data signals of sub-pixels of the fixation region in the display panel.

In a first scan period, a first sub-pixel row does not include the sub-pixels of the fixation region, and a gate drive module 201 corresponding to the first sub-pixel row provides first on signal, the first control module 211 provides a second on signal, and the second control module 221 provides off signal. The first on signal turns on first transistors 31 of N sub-pixels in the first sub-pixel row, the second on signal turns on second transistors 32 of N sub-pixels in the first sub-pixel row, and the off signal is transmitted to third transistors 33 of M sub-pixels in each sub-pixel column through a second control line 50 to turn off the third transistors 33 of the M sub-pixels. Because the third transistors 33 of all the sub-pixels of the first sub-pixel row are turned off, that is, input and output terminals of the switch assembly are turned off, data signals for all the sub-pixels of the first sub-pixel row are not refreshed. In the first scan period, a source drive circuit does not need to output data signals.

In a second scan period, a second sub-pixel row includes sub-pixels of the fixation region, and a gate drive module 201 corresponding to the second sub-pixel row provides the first on signal, and the first control module 211 provides the second on signal and the second control module 221 provides the third on and off signals. The first on signal turns on the first transistors 31 of the N sub-pixels in the second sub-pixel row, and the second on signal turns on the second transistors 32 of the N sub-pixels in the second sub-pixel row. The third on signal is transmitted to a third transistor 33 of a first sub-pixel P22 through a second control line 50 of a second sub-pixel column, and the third on signal is transmitted to a third transistor 33 of a second sub-pixel P23 through a second control line 50 of a third sub-pixel column so that the third transistors 33 of the two sub-pixels are turned on. The off signal is transmitted to third transistors 33 of other sub-pixels through second control lines 50 of other sub-pixel columns to turn off the third transistors 33 of other sub-pixels. Because the first transistor 31 and the second transistor 32 and the third transistor 33 of the first sub-pixel P22 and the second sub-pixel P23 are turned on, that is, the input and output terminals of the switch assembly are turned on, thus the data signals are transmitted to the pixel electrodes 36 of the first sub-pixel P22 and the second sub-pixel P23, and the data signals for the first sub-pixel P22 and the second sub-pixel P23 are refreshed. Because third transistors 33 of other sub-pixels are turned off, that is, the input and output terminals of the switch assembly are turned off, the data signals for other sub-pixels of the second sub-pixel row are not refreshed. In the second scan period, because the data signals for the first sub-pixel P22 and the second sub-pixel P23 of the second sub-pixel row are rewritten, source drive modules 301 corresponding to a second sub-pixel column and a third sub-pixel column need to output data signals. Because data signals for other sub-pixels do not need to be rewritten, source drive modules 301 corresponding to other sub-pixel columns do not need to output data signals.

In the second scan period, a third sub-pixel row includes sub-pixels of the fixation region, and a gate drive module 201 corresponding to the third sub-pixel row provides the first on signal, and the first control module 211 provides the second on signal and the second control module 221 provides the third on and off signals. The first on signal turns on the first transistors 31 of the N sub-pixels in the third sub-pixel row, and the second on signal turns on the second transistors 32 of the N sub-pixels in the third sub-pixel row. The third on signal is transmitted to a third transistor 33 of a third sub-pixel P32 through a second control line 50 of a second sub-pixel column, and the third on signal is transmitted to a third transistor 33 of a fourth sub-pixel P33 through a second control line 50 of a third sub-pixel column so that the third transistors 33 of the two sub-pixels are turned on. The off signal is transmitted to third transistors 33 of other sub-pixels through second control lines 50 of other sub-pixel columns to turn off the third transistors 33 of other sub-pixels. Because the first transistor 31 and the second transistor 32 and the third transistor 33 of the third sub-pixel P32 and the fourth sub-pixel P33 are turned on, that is, the input and output terminals of the switch assembly are turned on, so the data signals are transmitted to the pixel electrodes 36 of the third sub-pixel P32 and the fourth sub-pixel P33, and the data signals for the third sub-pixel P32 and the fourth sub-pixel P33 are refreshed. Because third transistors 33 of other sub-pixels are turned off, that is, the input and output terminals of the switch assembly are turned off, the data signals for other sub-pixels of the third sub-pixel row are not refreshed. In the third scan period, the source drive modules 301 corresponding to the second and third sub-pixel columns need to output data signals, while source drive modules 301 corresponding to other sub-pixel columns do not need to output data signals.

From a fourth scan period to an M-th scan period, a fourth sub-pixel row to an M-th sub-pixel row do not include sub-pixels of the fixation region, and the drive process is the same as that in the first scan period. Although the scan signal line and the first control line provide on signals row by row, because the second control line provides off signals, the data signals for all the sub-pixels from the fourth sub-pixel row to the M-th sub-pixel row are not refreshed, and the source drive circuit does not need to output the data signals.

In an exemplary embodiment, in subsequent pictures of display, a drive process of displaying odd frames is the same as that of displaying the first frame, and a drive process of displaying even frames is the same as that of displaying the second frame, which will not be repeatedly described here.

It may be seen from the drive process of the display panel in this exemplary embodiment that during the time of the two-frame display, the sub-pixels of the fixation region have experienced two data signal updates, and the sub-pixels of the non-fixation region have experienced one data signal updates, so a refresh rate of the sub-pixels of the fixation region is twice that of the sub-pixels of the non-fixation region.

According to an exemplary embodiment of the present disclosure, three transistors are disposed in a sub-pixel, and only when a first transistor, a second transistor and a third transistor in the sub-pixel are simultaneously turned on, a data signal for the sub-pixel may be refreshed, thus a partition refresh of the display panel is achieved, and there are different refresh rates in sub-pixels of the fixation region and sub-pixels of the non-fixation region. Because a gate drive module is used to control on and off of a first transistor through a scan signal line, a first control module is used to control on and off of a second transistor through the first control line and a second control module is used to control on and off of a third transistor through the second control line, the display panel may be partitioned arbitrarily, and the fixation region may be located at any position of the display panel. During the time of two-frame display, only data signals for sub-pixels of the fixation region are refreshed twice, while data signals for sub-pixels of the non-fixation region are refreshed only once, that is, only source drive module of sub-pixel columns where sub-pixels of the fixation region are located provides data signals twice, while other source drive modules only need to provide data signals once, thus effectively reducing the quantity of data signals provided by source drive circuits, effectively saving system resources for processing and transmitting data signals and effectively reducing system power consumption.

In the structure shown in FIG. 2, N sub-control lines are disposed between adjacent sub-pixel rows, and a first control module corresponding to a sub-pixel row may include N switches, and the N switches are respectively connected to the N sub-control lines correspondingly. In the structure shown in FIG. 5, a first control line is disposed between adjacent sub-pixel rows, and a first control module corresponding to a sub-pixel row may include a switch. Therefore, compared with the structure shown in FIG. 2, the structure shown in FIG. 5 not only effectively reduces the quantity of control lines between adjacent sub-pixel rows, which is beneficial to arrangements of sub-pixels, but also reduces the quantity of switches, which is beneficial to reducing costs.

Figure 6:
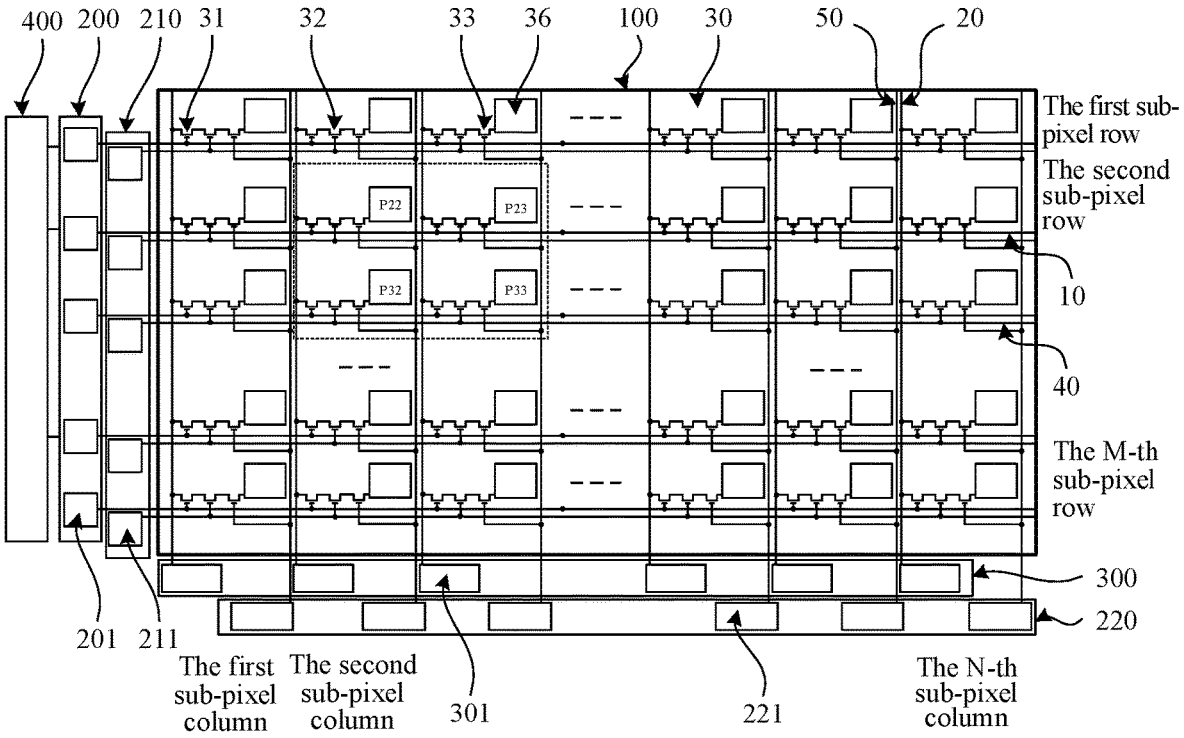
FIG. 6 is a schematic diagram of a structure of another display apparatus according to an exemplary embodiment of the present disclosure.

FIG. 6 is a schematic diagram of a structure of another display apparatus according to an exemplary embodiment of the present disclosure. On the basis of the display apparatus shown in FIG. 5, the display apparatus of this exemplary embodiment may further include a scan control circuit 400, which is connected to a gate drive circuit 200 and configured to provide an initial signal or a reset signal to the gate drive circuit 200, so as to scan a part of sub-pixel rows in a frame of display.

In this exemplary embodiment, a drive mode of the scan control circuit 400 is similar to the drive mode shown in FIG. 3. In a second frame of display, the scan control circuit 400 provides an initial signal to a gate drive module 201 corresponding to the second sub-pixel row, and provides all reset signals to a gate drive module 201 corresponding to the fourth sub-pixel row. The gate drive circuit only scans the second sub-pixel row and the third sub-pixel row, which is not repeatedly described here.

This exemplary embodiment may realize a partition refresh and an arbitrary partition of the display panel, which effectively saves system resources for processing and transmitting data signals, and scans for partial sub-pixel rows in a frame of display may be achieved by disposing scan control circuits, which increases the frame blank time, saves the system resources for processing and transmitting scan signals by the gate drive circuit, further saves the system resources and further reduces the system power consumption.

Figure 7:
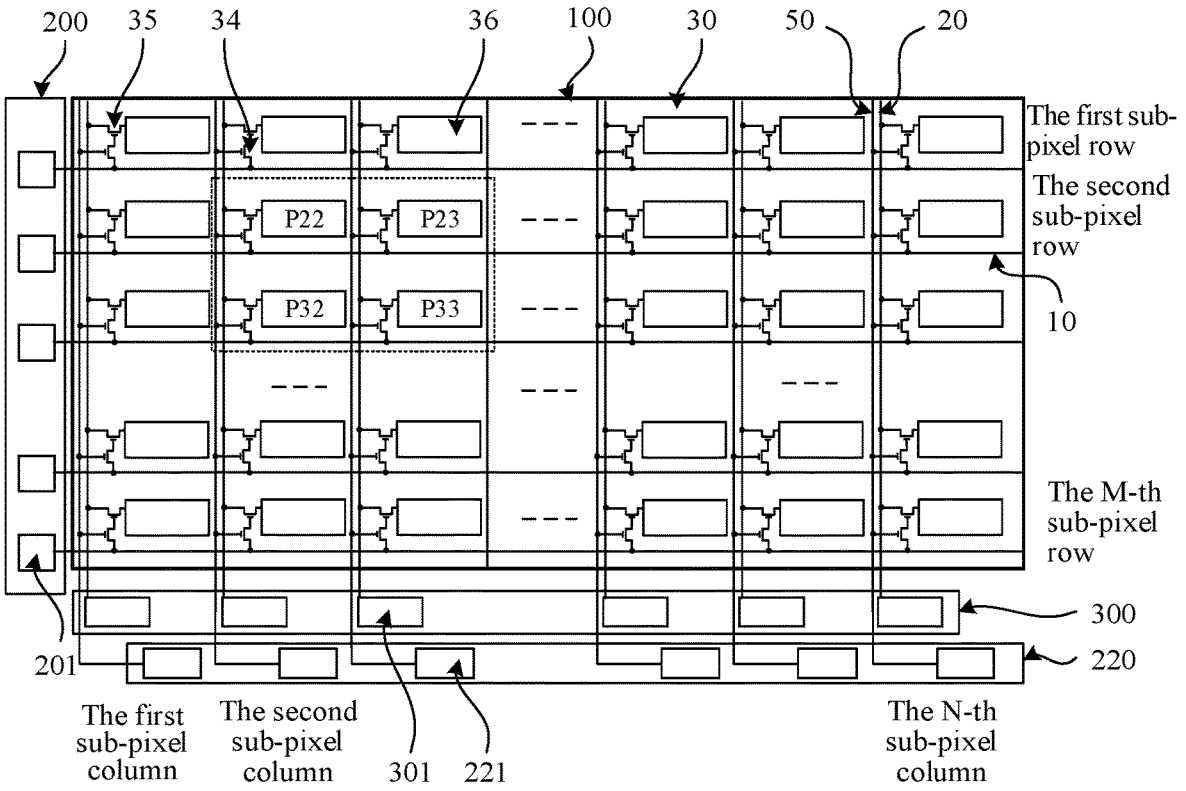
FIG. 7 is a schematic diagram of a structure of another display apparatus according to an exemplary embodiment of the present disclosure.

FIG. 7 is a schematic diagram of a structure of another display apparatus according to an exemplary embodiment of the present disclosure. As shown in FIG. 7, the display apparatus at least includes a display panel and a control circuit, and an LCD display panel is taken as an example of the display panel. In an exemplary embodiment, the display panel 100 may include M scan signal lines 10, N data signal lines 20 and M*N sub-pixels 30. The display panel 100 may further include N second control lines 50 as switch control lines, and the second control lines 50 may be disposed between adjacent sub-pixel columns. In an exemplary embodiment, a second control line 50 may be parallel to a data signal line.

In an exemplary embodiment, at least one sub-pixel 30 may include a fourth transistor 34, a fifth transistor 35, and a pixel electrode 36. The pixel electrode 36 serves as a display unit, and the fourth transistor 34 and the fifth transistor 35 serve as switch assembly. A gate electrode of the fourth transistor 34 serves as a first control terminal of the switch assembly, a first electrode of the fifth transistor 35 serves as an input terminal of the switch assembly, and a second electrode of the fifth transistor 35 serves as an output terminal of the switch assembly. The gate electrode of the fourth transistor 34 is connected to a second control line 50, a first electrode of the fourth transistor 34 is connected to a scan signal line 10, and a second electrode of the fourth transistor 34 is connected to a gate electrode of the fifth transistor 35. The first electrode of the fifth transistor 35 is connected to a data signal line 20, and the second electrode of the fifth transistor 35 is connected to the pixel electrode 36.

In an exemplary embodiment, the control circuit may include a gate drive circuit 200, a source drive circuit 300 and a second control circuit 220, wherein the gate drive circuit 200 is connected to M scan signal lines 10, the source drive circuit 300 is connected to N data signal lines 20, and the second control circuit 220 is connected to N second control lines 50.

In an exemplary embodiment, a gate drive circuit 200 may include M gate drive modules 201 which are connected to M scan signal lines 10 in an one-to-one correspondence. A source drive circuit 300 may include N source drive modules 301 which are connected to N data signal lines 20 in an one-to-one correspondence. The second control circuit 220 may include N second control modules 221 which are connected to N second control lines 50 in an one-to-one correspondence.

In an exemplary embodiment, a gate drive module 201 may be a GOA unit, and one gate drive module 201 is connected to a first end of a scan signal line 10 in a sub-pixel row in the display region 100, and a second end of the scan signal line 10 extends along a horizontal direction, is connected to first electrodes of fourth transistors 34 in N sub-pixels in the sub-pixel row, and outputs first on signals to the first electrodes of the fourth transistors 34 in the N sub-pixels.

In an exemplary embodiment, a source drive module 301 may be a Source drive unit (such as Source IC), and one source drive unit is connected to a first end of a data signal line 20 in a sub-pixel column in the display region 100, an second end of the data signal line 20 extends along a vertical direction and is connected to first electrodes of fifth transistors 35 in M sub-pixels, so that the data signal line 20 outputs data signals to the first electrodes of the fifth transistors 35 in the M sub-pixels in the sub-pixel column.

In an exemplary embodiment, a second control module 221 may be an switch (SW) unit, and one second control module 221 is connected to a first end of a second control line 50 in a sub-pixel column of the display region 100, and a second end of the second control line 50 extends along a vertical direction and is connected to gate electrodes of fourth transistors 34 of the M sub-pixels in the sub-pixel column, thereby controlling the fourth transistors 34 of the M sub-pixels to be turned on or off at the same time.

A first sub-pixel P22, a second sub-pixel P23, a third sub-pixel P32 and a fourth sub-pixel P33 being included in sub-pixels of the fixation region of the display panel are taken as examples to describe the drive process of the display panel according to this exemplary embodiment.

1. In a first frame of display, scan signal lines 10 of M sub-pixel rows provide on signals row by row, second control lines 50 of N sub-pixel columns provide on signals and data signal lines 20 of the N sub-pixel columns provide data signals to refresh data signals of all sub-pixels of the display panel.

In an exemplary embodiment, in an i-th scan period, a gate drive module 201 corresponding to an i-th sub-pixel row provides first on signal, and second control modules 221 of N sub-pixel columns provide third on signal, and source drive modules 301 of the N sub-pixel columns provide data signals. The third on signal is transmitted to gate electrodes of fourth transistors 34 of M sub-pixels through second control lines 50, so that the fourth transistors 34 of the M sub-pixels are simultaneously turned on. The first on signal is transmitted to first electrodes of fourth transistors 34 of N sub-pixels in the i-th sub-pixel row through the scan signal line, and then transmitted to gate electrodes of fifth transistors 35 through the turned-on fourth transistors 34, thereby turning on the fifth transistors 35 of the N sub-pixels. Because fourth transistors 34 and fifth transistors 35 of all sub-pixels in the i-th sub-pixel row are turned on, that is, input and output terminals of the switch assembly are turned on, data signals are transmitted to pixel electrodes 36 through the turned-on fourth transistor 34 and fifth transistor 35, and data signals of all the sub-pixels in the i-th sub-pixel row are refreshed.

2. In a second frame of display, a gate drive module 201 corresponding to M sub-pixel rows provides first on signals row by row, and the second control module 221 provides third on signals or off signals accordingly, so as to achieve refreshing the data signals of sub-pixels of the fixation region in the display panel.

In a first scan period, a first sub-pixel row does not include the sub-pixels of the fixation region, and a gate drive module 201 corresponding to the first sub-pixel row provides first on signals, and the second control module 221 provides off signals. The off signals are transmitted to the gate electrodes of the fourth transistors 34 of the M sub-pixels of each sub-pixel column through the second control lines 50, so that the fourth transistors 34 of the M sub-pixels are turned off. The first on signals of the gate drive modules 201 are transmitted to the first electrodes of the fourth transistors 34 of the N sub-pixels through the scan signal lines 10. Because a fourth transistor 34 of each sub-pixel is turned off, that is, an input terminal and an output terminal of the switch assembly are turned off, so the data signals for all sub-pixels of the first sub-pixel row are not refreshed. In the first scan period, a source drive circuit does not need to output data signals.

In a second scan period, a second sub-pixel row includes sub-pixels of the fixation region, and a gate drive module 201 of the second sub-pixel row provides a first on signal, and the second control module 221 provides a third on signal and an off signal. The third on signal is transmitted to a gate electrode of a fourth transistor 34 of a first sub-pixel P22 through a second control line 50 of a second sub-pixel column, and the third on signal is transmitted to a gate electrode of a fourth transistor 34 of a second sub-pixel P23 through a second control line 50 of a third sub-pixel column to turn on the fourth transistors 34 of the two sub-pixels. The off signals are transmitted to gate electrodes of fourth transistors 34 of other sub-pixels through second control lines 50 of other sub-pixel columns, so that the fourth transistors 34 of other sub-pixels except the two sub-pixels are turned off. The first on signal is transmitted to first electrodes of fourth transistors 34 of N sub-pixels in the second sub-pixel row through the scan signal line 10. Because only the fourth transistors 34 of the first sub-pixel P22 and the second sub-pixel P23 are turned on, so the fifth transistors 35 of the first sub-pixel P22 and the second sub-pixel P23 are turned on, the data signals are transmitted to the pixel electrodes 36 of the first sub-pixel P22 and the second sub-pixel P23, and the data signals of the first sub-pixel P22 and the second sub-pixel P23 are refreshed. Because fourth transistors 34 of other sub-pixels except the first sub-pixel P22 and the second sub-pixel P23 are turned off, so the fifth transistors 35 of other sub-pixels are turned off, and data signals of the other sub-pixels are not refreshed. In this way, data signals for the first sub-pixel P22 and the second sub-pixel P23 in the fixation region are rewritten, while the data signals for other sub-pixels in the second sub-pixel row do not need to be rewritten. In the second scan period, the source drive modules 301 corresponding to the second and third sub-pixel columns need to output data signals, while source drive modules 301 corresponding to other sub-pixel columns do not need to output data signals.

In a third scan period, a third sub-pixel row includes sub-pixels of the fixation region, and a gate drive module 201 corresponding to the third sub-pixel row provides a first on signal, and the second control module 221 provides a third on signal and an off signal. The third on signal is transmitted to a gate electrode of a fourth transistor 34 of a third sub-pixel P32 through a second control line 50 of a second sub-pixel column, and the third on signal is transmitted to a gate electrode of a fourth transistor 34 of a fourth sub-pixel P33 through a second control line 50 of a third sub-pixel column to turn on the fourth transistors 34 of the two sub-pixels. The first on signal turns the fifth transistor 35 of the third sub-pixel P32 and the fifth transistor 35 of the fourth sub-pixel P33 on, and data signals are transmitted to the pixel electrode 36 of the third sub-pixel P32 and the pixel electrode 36 of the fourth sub-pixel P33, and the data signals of the third sub-pixel P32 and the fourth sub-pixel P33 are refreshed. The off signal turns off fourth transistors 34 of other sub-pixels except the two sub-pixels, and the data signals of the other sub-pixels are not refreshed. In the third scan period, the source drive modules 301 corresponding to the second and third sub-pixel columns need to output data signals, while source drive modules 301 corresponding to other sub-pixel columns do not need to output data signals.

From a fourth scan period to an M-th scan period, a fourth sub-pixel row to an M-th sub-pixel row do not include sub-pixels of the fixation region, and the control process is the same as that in the first scan period. All the data signals of the sub-pixels from the fourth sub-pixel row to the M-th sub-pixel row are not refreshed, and the source drive circuit does not need to output the data signals.

In an exemplary embodiment, in subsequent pictures of display, a drive process of displaying odd frames is the same as that of displaying the first frame, and a drive process of displaying even frames is the same as that of displaying the second frame, which will not be repeatedly described here.

It may be seen from the drive process of the display panel in this exemplary embodiment that during the time of the two-frame display, the data signals of the sub-pixels of the fixation region have been refreshed two times, and the data signals of the sub-pixels of the non-fixation region have been refreshed one time, so a refresh rate of the sub-pixels of the fixation region is twice that of the sub-pixels of the non-fixation region.

According to an exemplary embodiment of the present disclosure, two transistors are disposed in a sub-pixel, and only when a fourth transistor and a fifth transistor in the sub-pixel are simultaneously turned on, the data signal of the sub-pixel may be refreshed, thus a partition refresh of the display panel is achieved, and there are different refresh rates in sub-pixels of the fixation region and sub-pixels of the non-fixation region. Because a gate drive module is used to control on and off of a transistor through a scan signal line and a second control module is used to control on and off of another transistor through the second control line, the display panel may be partitioned arbitrarily, and the fixation region may be located at any position of the display panel. During the time of two-frame display, only data signals of sub-pixels of the fixation region are refreshed twice, while data signals of sub-pixels of the non-fixation region are refreshed only once, that is, only source drive module of sub-pixel columns where sub-pixels of the fixation region are located provides data signals twice, while other source drive modules only need to provide data signals once, thus effectively reducing the quantity of data signals provided by source drive circuits, effectively saving system resources for processing and transmitting data signals and effectively reducing system power consumption.

In the structure shown in FIG. 5, a first control line is disposed between adjacent sub-pixel rows, and the control circuit includes a first control circuit. In the structure shown in FIG. 7, there is no first control line disposed between adjacent sub-pixel rows, and the control circuit does not include a first control circuit. Therefore, compared with the structure shown in FIG. 5, the structure shown in FIG. 7 effectively reduces the quantity of control lines and control circuits, which is beneficial to arrangements of sub-pixels and the cost reduction.

Figure 8:
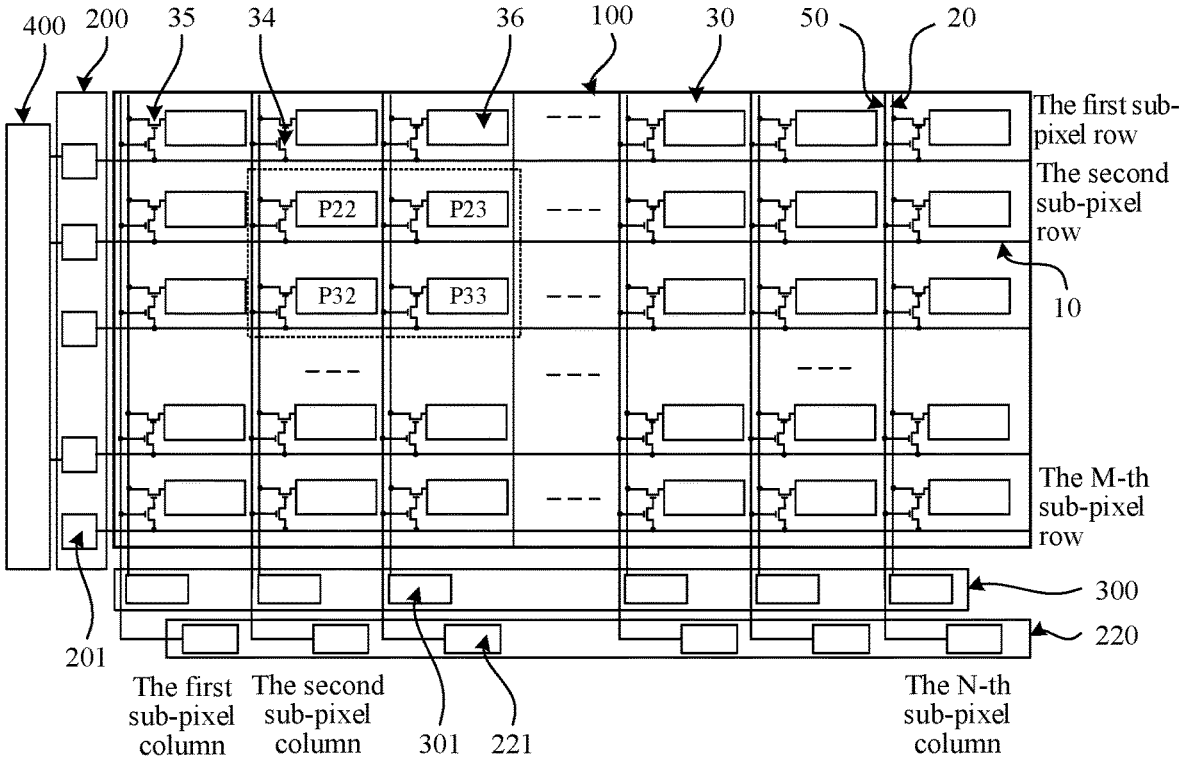
FIG. 8 is a schematic diagram of a structure of another display apparatus according to an exemplary embodiment of the present disclosure.

FIG. 8 is a schematic diagram of a structure of another display apparatus according to an exemplary embodiment of the present disclosure. On the basis of the display apparatus shown in FIG. 7, the display apparatus of this exemplary embodiment may further include a scan control circuit 400, which is connected to a gate drive circuit 200 and configured to provide an initial signal or a reset signal to the gate drive circuit 200, so as to scan a part of sub-pixel rows in a frame of display.

In this exemplary embodiment, a drive mode of the scan control circuit 400 is similar to the drive mode shown in FIG. 3. In a second frame of display, the scan control circuit 400 provides an initial signal to a gate drive module 201 corresponding to the second sub-pixel row, and provides all reset signals to a gate drive module 201 corresponding to the fourth sub-pixel row. The gate drive circuit only scans the second sub-pixel row and the third sub-pixel row, which is not repeatedly described here.

In this exemplary embodiment, not only a partition refresh and an arbitrary partition of the display panel may be achieved, which effectively saves system resources for processing and transmitting data signals, but also scans of partial sub-pixel rows in a frame of display may be achieved by disposing scan control circuits, which increases the frame blank time, saves the system resources for processing and transmitting scan signals by the gate drive circuit, further saves the system resources and further reduces the system power consumption.

Figure 9:
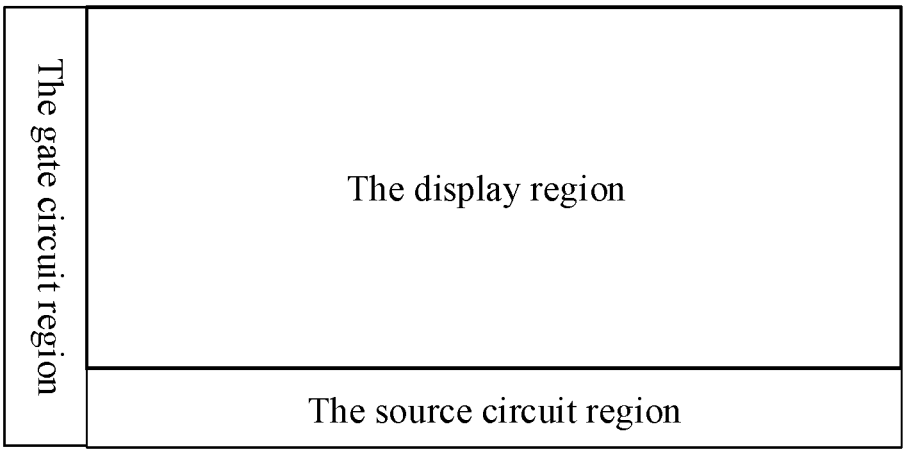
FIG. 9 is a schematic diagram of a structure of a display panel according to an exemplary embodiment of the present disclosure.

FIG. 9 is a schematic diagram of a structure of a display panel according to an exemplary embodiment of the present disclosure. As shown in FIG. 9, in an exemplary embodiment, the display panel may include a display region 100 and a circuit region, wherein the circuit region may include a gate circuit region located on one or both sides of the display region 100 in a horizontal direction and a source circuit region located on one or both sides of the display region 100 in a vertical direction.

In this exemplary embodiment, the gate drive circuit and the first control circuit may be disposed in the gate circuit region, and the source drive circuit and the second control circuit may be disposed in the source circuit region.

In an exemplary embodiment, the display apparatus of the foregoing exemplary embodiment may be any product or component with a display function such as a mobile phone, a tablet computer, a television, a display, a laptop, a digital photo frame, a navigator, etc.

An exemplary embodiment of the present disclosure further provides a drive method for a display panel, wherein the display panel is the one in any of the foregoing exemplary embodiments. In this exemplary embodiment, the drive method for the display panel may include:

S1. acquiring a fixation position of a viewer on the display panel, and determining sub-pixels of a fixation region and sub-pixels of a non-fixation region in the display panel according to the fixation position;

S2. controlling refresh rates of the sub-pixels of the fixation region to be greater than refresh rates of the sub-pixels of the non-fixation region.

In the present exemplary embodiment, step S2 may include: S21. controlling input terminals and output terminals of the switch assembly in the sub-pixels of the fixation region and the sub-pixels of the non-fixation region to be turned on for all sub-pixel rows of the display panel when a first frame is displayed;

S22. controlling input terminals and output terminals of the switch assembly in the sub-pixels of the fixation region to be turned on and controlling input terminals and output terminals of the switch assembly in the sub-pixels of the non-fixation region to be turned off for all sub-pixel rows of the display panel when a second frame is displayed.

In this exemplary embodiment, the switch control line includes a first control line, and the switch assembly includes a first transistor and a second transistor; step S22 may include:

for sub-pixel rows that do not include the sub-pixels of the fixation region, the scan signal line outputting a first on signal to turn a first transistor of each sub-pixel of the sub-pixel row on;

the first control line outputting an off signal to turn a second transistor of each sub-pixel of the sub-pixel row off;

for sub-pixel rows including the sub-pixels of the fixation region, the scan signal line outputting a first on signal to turn a first transistor of each sub-pixel of the sub-pixel row on; the first control line outputting a second on signal and an off signal, wherein the second on signal is output to the sub-pixels of the fixation region and the off signal is output to the sub-pixels of the non-fixation region to turn the second transistor of the sub-pixels of the fixation region on and turn the second transistor of the sub-pixels of the non-fixation region off.

In this exemplary embodiment, the switch control line includes a first control line and a second control line, and the switch assembly includes a first transistor, a second transistor and a third transistor; step S22 may include:

for sub-pixel rows that do not include the sub-pixels of the fixation region, the scan signal line outputting a first on signal to turn a first transistor of each sub-pixel of the sub-pixel row on;

the first control line outputting a second on signal to turn a second transistor of each sub-pixel of the sub-pixel row on; the second control line outputting an off signal to turn a third transistor of each sub-pixel of the sub-pixel row off;

for sub-pixel rows including the sub-pixels of the fixation region, the scan signal line outputting a first on signal to turn a first transistor of each sub-pixel of the sub-pixel row on; the first control line outputting a second on signal to turn a second transistor of each sub-pixel of the sub-pixel row on; the second control line outputting a third on signal and an off signal, wherein the third on signal is output to the sub-pixels of the fixation region and the off signal is output to the sub-pixels of the non-fixation region to turn a third transistor of the sub-pixels of the fixation region on and turn a third transistor of the sub-pixels of the non-fixation region off.

In this exemplary embodiment, the switch control line includes a second control line, and the switch assembly includes a fourth transistor and a fifth transistor; step S22 may include:

for sub-pixel rows that do not include the sub-pixels of the fixation region, the second control line outputting an off signal to turn a fourth transistor of each sub-pixel of the sub-pixel row on; the scan signal line outputting a first on signal;

for sub-pixel rows including the sub-pixels of the fixation region, the second control line outputting a third on signal and an off signal, wherein the third on signal is output to the sub-pixels of the fixation region and the off signal is output to the sub-pixels of the non-fixation region to turn a fourth transistor of the sub-pixels of the fixation region on and turn a fourth transistor of the sub-pixels of the non-fixation region off; the scan signal line outputting a first on signal to turn a fifth transistor of the sub-pixel of the fixation region on.

In the present exemplary embodiment, step S2 may include:

controlling input terminals and output terminals of the switch assembly in the sub-pixels of the fixation region and the sub-pixels of the non-fixation region to be turned on when a first frame is displayed;

for sub-pixel rows including sub-pixels of the fixation region of the display panel, controlling input terminals and output terminals of the switch assembly in the sub-pixels of the fixation region to be turned on and controlling input terminals and output terminals of the switch assembly in the sub-pixels of the non-fixation region to be turned off when a second frame is displayed.

In this exemplary embodiment, only sub-pixel rows including sub-pixels of the fixation region may be scanned by the scan control circuit in the control circuit.

Although the embodiments disclosed in the present disclosure are as described above, the described contents are only the embodiments for facilitating understanding of the present disclosure, which are not intended to limit the present disclosure. Those of ordinary skilled in the art to which the present disclosure pertains may make any modifications and variations in the form and details of implementation without departing from the spirit and the scope of the present disclosure. Nevertheless, the scope of patent protection of the present disclosure shall still be determined by the scope defined by the appended claims.

What we claim is:

1. A display panel, comprising:

a plurality of scan signal lines, a plurality of data signal lines and a plurality of sub-pixels, wherein at least one of the plurality of sub-pixels comprises a switch assembly and a display unit, wherein the switch assembly at least comprises a control terminal, an input terminal and an output terminal, wherein the input terminal is connected to the data signal line, the output terminal is connected to the display unit, and the control terminal or the input terminal is connected to the scan signal line;

the display panel further comprises at least one switch control line connected to the control terminal of the switch assembly, and the switch control line is configured to control on or off of the input terminal and the output terminal of the switch assembly;

the plurality of sub-pixels of the display panel include sub-pixels of a fixation region and sub-pixels of a non-fixation region; and a refresh rate of the sub-pixels of the fixation region is greater than a refresh rate of the sub-pixels of the non-fixation region.

2. The display panel of claim 1, wherein the control terminal of the switch assembly comprises a first control terminal and a second control terminal, the switch assembly comprises a first transistor and a second transistor, and the switch control line comprises a first control line; a gate electrode of the first transistor serves as the first control terminal and is connected to the scan signal line, a gate electrode of the second transistor serves as the second control terminal and is connected to the first control line, a first electrode of the first transistor serves as the input terminal and is connected to the data signal line, a second electrode of the first transistor is connected to a first electrode of the second transistor, and a second electrode of the second transistor serves as the output terminal and is connected to the display unit.

3. The display panel of claim 2, wherein at least one of the plurality of scan signal lines is connected to gate electrodes of first transistors of a plurality of sub-pixels in a sub-pixel row; the first control line comprises a plurality of sub-control lines, and each sub-control line is connected to gate electrodes of second transistors of the plurality of sub-pixels in a sub-pixel row.

4. The display panel of claim 1, wherein the control terminal of the switch assembly comprises a first control terminal, a second control terminal and a third control terminal, the switch assembly comprises a first transistor, a second transistor and a third transistor, the switch control line comprise a first control line and a second control line, a gate electrode of the first transistor serves as the first control terminal and is connected to the scan signal line, a gate electrode of the second transistor serves as the second control terminal and is connected to the first control line, a gate electrode of the third transistor serves as the third control terminal and is connected to the second control line, a first electrode of the first transistor serves as the input terminal and is connected to the data signal line, a second electrode of the first transistor is connected to a first electrode of the second transistor, a second electrode of the second transistor is connected to a first electrode of the third transistor and a second electrode of the third transistor serves as the output terminal and is connected to the display unit.

5. The display panel of claim 4, wherein at least one of the plurality of scan signal lines is connected to gate electrodes of first transistors of a plurality of sub-pixels in a sub-pixel row; the first control line is connected to gate electrodes of second transistors of a plurality of sub-pixels in a sub-pixel row; and the second control line is connected to gate electrodes of third transistors of a plurality of sub-pixels in a sub-pixel column.

6. The display panel of claim 1, wherein the control terminal of the switch assembly comprises a first control terminal, the switch assembly comprises a fourth transistor and a fifth transistor, and the switch control line comprises a second control line; a gate electrode of a fourth transistor serves as the first control terminal and is connected to the second control line, a first electrode of the fourth transistor is connected to the scan signal line, a second electrode of the fourth transistor is connected to a gate electrode of the fifth transistor, a first electrode of the fifth transistor serves as the input terminal and is connected to the data signal line and a second electrode of the fifth transistor serves as the output terminal and is connected to the display unit.

7. The display panel of claim 6, wherein at least one of the plurality of scan signal lines is connected to first electrodes of fourth transistors of a plurality of sub-pixels in a sub-pixel row; the second control line is connected to gate electrodes of fourth transistors of a plurality of sub-pixels in a sub-pixel column.

8. The display panel of claim 2, wherein the first control line is parallel to the scan signal lines and the second control line is parallel to the data signal lines.

9. The display panel of claim 1, wherein the display unit comprises a pixel electrode, or the display unit comprises a pixel circuit and a light emitting device.

10. A drive method for a display panel, wherein the display panel comprises a plurality of scan signal lines, a plurality of data signal lines and a plurality of sub-pixels, wherein at least one of the plurality of sub-pixels comprises switch assembly and a display unit, wherein the switch assembly at least comprises a control terminal, an input terminal and an output terminal, wherein the input terminal is connected to the data signal lines, the output terminal is connected to the display unit, and the control terminal or the input terminal is connected to the scan signal lines;

the display panel further comprises at least one switch control line which is connected to the control terminal of the switch assembly and is configured to control on or off of the input terminal and the output terminal of the switch assembly;

the drive method comprises:

acquiring a fixation position of a viewer on the display panel, and determining sub-pixels of a fixation region and sub-pixels of a non-fixation region in the display panel according to the fixation position;

controlling a refresh rate of the sub-pixels of the fixation region to be greater than a refresh rate of the sub-pixels of the non-fixation region.

11. The drive method of claim 10, wherein controlling the refresh rate of the sub-pixels of the fixation region to be greater than the refresh rate of the sub-pixels of the non-fixation region comprises:

controlling the input terminal and the output terminal of the switch assembly in the sub-pixels of the fixation region and the sub-pixels of the non-fixation region to be turned on for all sub-pixel rows of the display panel when a first frame is displayed;

controlling the input terminal and the output terminal of the switch assembly in the sub-pixels of the fixation region to be turned on and controlling the input terminals and the output terminals of the switch assembly in the sub-pixels of the non-fixation region to be turned off for all sub-pixel rows of the display panel when a second frame is displayed.

12. The drive method of claim 11, wherein the switch control line comprises a first control line, and the switch assembly comprises a first transistor and a second transistor;

controlling the input and output terminals of the switch assembly in the sub-pixels of the fixation region to be turned on, and controlling the input and output terminals of the switch assembly in the sub-pixels of the non-fixation region to be turned off, comprises:

for sub-pixel rows that do not comprise the sub-pixels of the fixation region, the plurality of scan signal lines outputting first on signals to turn a first transistor of each sub-pixel of the sub-pixel rows on; the first control line outputting an off signal to turn a second transistor of each sub-pixel of the sub-pixel rows off;

for sub-pixel rows comprising the sub-pixels of the fixation region, the scan signal lines outputting first on signals to turn a first transistor of each sub-pixel of the sub-pixel rows on; the first control line outputting a second on signal and an off signal, wherein the second on signal is output to the sub-pixels of the fixation region and the off signal is output to the sub-pixels of the non-fixation region to turn the second transistors of the sub-pixels of the fixation region on and turn the second transistors of the sub-pixels of the non-fixation region off.

13. The drive method of claim 11, wherein the switch control line comprises a first control line and a second control line, and the switch assembly comprises a first transistor, a second transistor and a third transistor; controlling the input and output terminals of the switch assembly in the sub-pixels of the fixation region to be turned on, and controlling the input and output terminals of the switch assembly in the sub-pixels of the non-fixation region to be turned off, comprises:

for sub-pixel rows that do not comprise the sub-pixels of the fixation region, the scan signal lines outputting first on signals to turn a first transistor of each sub-pixel of the sub-pixel rows on; the first control line outputting a second on signal to turn a second transistor of each sub-pixel of the sub-pixel rows on; the second control line outputting an off signal to turn a third transistor of each sub-pixel of the sub-pixel rows off;

for sub-pixel rows comprising the sub-pixels of the fixation region, the scan signal lines outputting first on signals to turn a first transistor of each sub-pixel of the sub-pixel rows on; the first control line outputting a second on signal to turn a second transistor of each sub-pixel of the sub-pixel rows on; the second control line outputting a third on signal and an off signal, wherein the third on signal is output to the sub-pixels of the fixation region and the off signal is output to the sub-pixels of the non-fixation region to turn third transistors of the sub-pixels of the fixation region on and turn third transistors of the sub-pixels of the non-fixation region off.

14. The drive method of claim 11, wherein the switch control line comprises a second control line, and the switch assembly comprises a fourth transistor and a fifth transistor;

controlling the input and output terminals of the switch assembly in the sub-pixels of the fixation region to be turned on, and controlling the input and output terminals of the switch assembly in the sub-pixels of the non-fixation region to be turned off, comprises:

for sub-pixel rows that do not comprise the sub-pixels of the fixation region, the second control line outputting an off signal to turn a fourth transistor of each sub-pixel of the sub-pixel row on; the scan signal lines outputting first on signals;

for sub-pixel rows comprising the sub-pixels of the fixation region, the second control line outputting a third on signal and an off signal, wherein the third on signal is output to the sub-pixels of the fixation region and the off signal is output to the sub-pixels of the non-fixation region to turn fourth transistors of the sub-pixels of the fixation region on and turn fourth transistors of the sub-pixels of the non-fixation region off, the scan signal lines outputting first on signals to turn fifth transistors of the sub-pixels of the fixation region on.

15. The drive method of claim 10, wherein controlling the refresh rate of the sub-pixels of the fixation region to be greater than the refresh rate of the sub-pixels of the non-fixation region comprises:

controlling input terminal and output terminal of the switch assembly in the sub-pixels of the fixation region and the sub-pixels of the non-fixation region to be turned on when a first frame is displayed;

for sub-pixel rows comprising sub-pixels of the fixation region, controlling input terminal and output terminal of the switch assembly in the sub-pixels of the fixation region to be turned on and controlling input terminal and output terminal of the switch assembly in the sub-pixels of the non-fixation region to be turned off when a second frame is displayed.

16. A display apparatus, comprising:

a vision tracking device, a control circuit and a display panel, wherein the display panel comprises a plurality of scan signal lines, a plurality of data signal lines and a plurality of sub-pixels, wherein at least one of a plurality of sub-pixels comprises switch assembly and a display unit, wherein the switch assembly at least comprises a control terminal, an input terminal and an output terminal, wherein the input terminal is connected to the data signal lines, the output terminal is connected to the display unit, and the control terminal or the input terminal is connected to the scan signal lines;

the display panel further comprises at least one switch control line which is connected to the control terminal of the switch assembly and is configured to control on or off of the input terminal and the output terminal of the switch assembly;

the control circuit is connected to the visual tracking device and the display panel;

the vision tracking device is configured to acquire a fixation position of a viewer on the display panel, and determine sub-pixels of a fixation region and sub-pixels of a non-fixation region in the display panel according to the fixation position;

the control circuit is configured to control a refresh rate of the sub-pixels in the fixation region to be greater than a refresh rate of the sub-pixels in the non-fixation region.

17. The display apparatus of claim 16, wherein the control circuit comprises a gate drive circuit and a first control circuit, the gate drive circuit is connected to at least one scan signal line of the plurality of scan signal lines, and the first control circuit is connected to at least one first control line; or, the control circuit comprises a gate drive circuit, a first control circuit, and a second control circuit, the gate drive circuit is connected to at least one of the plurality of scan signal lines, and the first control circuit is connected to at least one first control line, and the second control circuit is connected to at least one second control line; or, the control circuit comprises a gate drive circuit and a second control circuit, wherein the gate drive circuit is connected to at least one of the plurality of scan signal lines, and the second control circuit is connected to at least one second control line.

18. The display apparatus of claim 17, wherein the control circuit further comprises a scan control circuit connected to the gate drive circuit, and the scan control circuit is configured to provide an initial signal or a reset signal to the gate drive circuit to scan a part of sub-pixel rows in a frame of display.

19. The display apparatus of claim 16, wherein the display panel comprises a display region and a circuit region located on one or more sides of the display region, and the control circuit is disposed in the circuit region.

* * * * *